US010984804B2

(12) United States Patent
Lecomte et al.

(10) Patent No.: US 10,984,804 B2
(45) Date of Patent: Apr. 20, 2021

(54) HYBRID CONCEALMENT METHOD: COMBINATION OF FREQUENCY AND TIME DOMAIN PACKET LOSS CONCEALMENT IN AUDIO CODECS

(71) Applicant: Fraunhofer-Gesellschaft zur Foerderung der angewandten Forschung e.V., Munich (DE)

(72) Inventors: Jérémie Lecomte, Santa Clara, CA (US); Adrian Tomasek, Zirndorf (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 186 days.

(21) Appl. No.: 16/125,348

(22) Filed: Sep. 7, 2018

(65) Prior Publication Data

US 2019/0005967 A1 Jan. 3, 2019

Related U.S. Application Data

(63) Continuation of application No. PCT/EP2016/061865, filed on May 25, 2016.

(30) Foreign Application Priority Data

Mar. 7, 2016 (EP) ..... 16159031

(51) Int. Cl.
*G10L 19/005* (2013.01)
*G10L 19/02* (2013.01)
(Continued)

(52) U.S. Cl.
CPC ..... *G10L 19/005* (2013.01); *G10L 19/025* (2013.01); *G10L 19/0212* (2013.01);
(Continued)

(58) Field of Classification Search
CPC . G10L 19/0017; G10L 19/005; G10L 19/028; G10L 19/04; G10L 19/18;
(Continued)

(56) References Cited

U.S. PATENT DOCUMENTS 6,301,588 B1 10/2001 Aoki
7,864,843 B2 * 1/2011 Choo ..... G10L 19/0208 704/264
(Continued)

FOREIGN PATENT DOCUMENTS

EP 1684267 A2 7/2006
EP 2874149 A1 5/2015
(Continued)

OTHER PUBLICATIONS

3GPP TS 26.445, "3rd Generation Partnership Project; Technical Specification Group Services and System Aspects; Codec for Enhanced Voice Services (EVS); Detailed Algorithmic Description (Release 12)", 3GPP Standard; 3GPP TS 26.445, 3rd Generation Partnership Project (3GPP), Mobile Competence Centre, 650, Route Des Lucioles; F-06921 Sophia-Antipolis Cedex; France, vol. SA WG4, No. V12. 5.0, Bandwidth extension in time domain, Dec. 7, 2015, 49 pages.
(Continued)

*Primary Examiner* — Martin Lerner
(74) *Attorney, Agent, or Firm* — Perkins Coie LLP; Michael A. Glenn

(57) ABSTRACT

Embodiments of the invention relate to an error concealment unit for providing an error concealment audio information for concealing a loss of an audio frame in an encoded audio information. The error concealment unit provides a first error concealment audio information component for a first frequency range using a frequency domain concealment. The error concealment unit also provides a second error concealment audio information component for a second
(Continued)

frequency range, which includes lower frequencies than the first frequency range, using a time domain concealment. The error concealment unit also combines the first error concealment audio information component and the second error concealment audio information component, to obtain the error concealment audio information. Other embodiments of the invention relate to a decoder including the error concealment unit, as well as related encoders, methods, and computer programs for decoding and/or concealing.

36 Claims, 19 Drawing Sheets

(51) Int. Cl.

| | |
|---|---|
| ***G10L 19/025*** | (2013.01) |
| ***G10L 19/125*** | (2013.01) |
| *G10L 19/18* | (2013.01) |
| *G10L 19/22* | (2013.01) |
| *G10L 19/04* | (2013.01) |
| *G10L 19/00* | (2013.01) |

(52) U.S. Cl.
CPC ..... *G10L 19/125* (2013.01); *G10L 19/04* (2013.01); *G10L 2019/0002* (2013.01)

(58) Field of Classification Search
CPC ..... G10L 19/20; G10L 19/22; G10L 19/24; G10L 21/0224; G10L 21/0232; G10L 21/038
USPC ..... 704/205, 206, 211, 219, 500, 501
See application file for complete search history.

(56) References Cited

U.S. PATENT DOCUMENTS

| | | | | |
|---|---|---|---|---|
| 8,165,128 | B2 | 4/2012 | Sun et al. | |
| 8,798,172 | B2 * | 8/2014 | Oh | G10L 19/005 375/240.27 |
| 9,280,975 | B2 * | 3/2016 | Sung | G10L 19/22 |
| 9,712,414 | B2 * | 7/2017 | Bruhn | G10L 19/00 |
| 10,262,662 | B2 * | 4/2019 | Lecomte | G10L 19/005 |
| 10,269,358 | B2 * | 4/2019 | Lecomte | G10L 19/125 |
| 10,269,359 | B2 * | 4/2019 | Lecomte | G10L 19/09 |
| 10,283,124 | B2 * | 5/2019 | Lecomte | G10L 19/02 |
| 10,290,308 | B2 * | 5/2019 | Lecomte | G10L 19/26 |
| 10,339,946 | B2 * | 7/2019 | Lecomte | G10L 19/022 |
| 10,373,621 | B2 * | 8/2019 | Lecomte | G10L 19/09 |
| 10,381,012 | B2 * | 8/2019 | Lecomte | G10L 19/02 |
| 10,706,858 | B2 * | 7/2020 | Lecomte | G10L 19/028 |
| 2002/0103637 | A1 * | 8/2002 | Henn | G10L 21/038 704/206 |
| 2003/0233234 | A1 * | 12/2003 | Truman | G10L 19/035 704/203 |
| 2006/0265087 | A1 * | 11/2006 | Philippe | G10L 19/0208 700/94 |
| 2007/0271480 | A1 | 11/2007 | Oh et al. | |
| 2007/0299656 | A1 * | 12/2007 | Son | G10L 21/038 704/205 |
| 2010/0017200 | A1 | 1/2010 | Oshikiri et al. | |
| 2010/0063827 | A1 * | 3/2010 | Gao | G10L 21/038 704/500 |
| 2011/0099018 | A1 * | 4/2011 | Neuendorf | G10L 21/038 704/500 |
| 2014/0142957 | A1 * | 5/2014 | Sung | G10L 19/005 704/500 |
| 2014/0207445 | A1 | 7/2014 | Gao et al. | |
| 2015/0142452 | A1 | 5/2015 | Sung et al. | |
| 2015/0228288 | A1 * | 8/2015 | Subasingha | G10L 21/038 704/500 |
| 2016/0086614 | A1 * | 3/2016 | Ullberg | G10L 19/028 704/501 |
| 2018/0040006 | A1 | 2/2018 | Kim et al. | |

FOREIGN PATENT DOCUMENTS

| | | | |
|---|---|---|---|
| JP | 2007514977 | A | 6/2007 |
| KR | 20140126095 | A | 10/2014 |
| KR | 20160098865 | A | 8/2016 |
| RU | 2488897 | C1 | 7/2013 |
| WO | 2005059900 | A1 | 6/2005 |
| WO | 2008062959 | A1 | 5/2008 |
| WO | 2008151408 | A1 | 12/2008 |
| WO | 2014123471 | A1 | 8/2014 |
| WO | 2014202535 | A1 | 12/2014 |
| WO | 2014202539 | A1 | 12/2014 |
| WO | 2015063044 | A1 | 5/2015 |
| WO | 2015063045 | A1 | 5/2015 |
| WO | 2016030327 | A2 | 3/2016 |

OTHER PUBLICATIONS

3GPP, TS 26.402, "Technical Specification Digital Cellular Telecommunications System (Phase 2+); Universal Mobile Telecommunications System (UMTS); LTE; General Audio Codec Audio Processing Functions; Enhanced aacPlus General Audio Codec; Additional Decoder Tools", 3GPP TS 26.402 3rd Generation Partnership Project, 3GPP TS 26.402 Version 11.0.0 Release 11, Oct. 2012, 19 Pages.

Lecomte, Jeremie et al., "Enhanced Time Domain Packet Loss Concealment in Switched Speech/Audio Codec", IEEE ICASSP, Brisbane, Australia, This paper describes new time domain techniques for concealing packet loss in the new 3GPP Enhanced Voice Services codec., Apr. 2015.

Lecomte, Jeremie et al., "Packet-Loss Concealment Technology Advances in EVS", 2015 IEEE International Conference on Acoustics, Speech and Signal Processing (ICASSP), Apr. 1, 2015, 5 pages.

Park, Nam I. et al., "A Packet Loss Concealment Technique Improving Quality of Service for Wideband Speech Coding in Wireless Sensor Networks", Hindawi Publishing Corporation, International Journal of Distributed Sensor Networks, vol. 2014, Article ID 852798, A packet loss concealment (PLC) algorithm is proposed to improve the quality of decoded speech when packet losses occur in a wireless sensor network., Apr. 17, 2014, 9 Pages.

"EVS Codec Error Concealment of Lost Packets", ETSI TS 126 447 V12.0.0. 3GPP TS 26.447 version 12.0.0 Release 12, Oct. 2014, Oct. 2014.

* cited by examiner

| Fig. 4 | |
|---|---|
| Fig. 4a | Fig. 4b |

| Fig. 4 | |
|---|---|
| Fig. 4a | Fig. 4b |

Time domain concealment overview for transform decoder

Time domain concealment overview for switch codec

1200

HYBRID CONCEALMENT METHOD: COMBINATION OF FREQUENCY AND TIME DOMAIN PACKET LOSS CONCEALMENT IN AUDIO CODECS

CROSS-REFERENCE TO RELATED APPLICATIONS

This application is a continuation of copending International Application No. PCT/EP2016/061865, filed May 25, 2016, which is incorporated herein by reference in its entirety, and additionally claims priority from European Application No. 16159031.0, filed Mar. 7, 2016, which is also incorporated herein by reference in its entirety.

1. TECHNICAL FIELD

Embodiments according to the invention create error concealment units for providing an error concealment audio information for concealing a loss of an audio frame in an encoded audio information based on a time domain concealment component and a frequency domain concealment component.

Embodiments according to the invention create audio decoders for providing a decoded audio information on the basis of an encoded audio information, the decoders comprising said error concealment units.

Embodiments according to the invention create audio encoders for providing an encoded audio information and further information to be used for concealment functions, if needed.

Some embodiments according to the invention create methods for providing an error concealment audio information for concealing a loss of an audio frame in an encoded audio information based on a time domain concealment component and a frequency domain concealment component.

Some embodiments according to the invention create computer programs for performing one of said methods.

2. BACKGROUND OF THE INVENTION

In recent years there is an increasing demand for a digital transmission and storage of audio contents. However, audio contents are often transmitted over unreliable channels, which brings along the risk that data units (for example, packets) comprising one or more audio frames (for example, in the form of an encoded representation, like, for example, an encoded frequency domain representation or an encoded time domain representation) are lost. In some situations, it would be possible to request a repetition (resending) of lost audio frames (or of data units, like packets, comprising one or more lost audio frames). However, this would typically bring a substantial delay, and would therefore involve an extensive buffering of audio frames. In other cases, it is hardly possible to request a repetition of lost audio frames.

In order to obtain a good, or at least acceptable, audio quality given the case that audio frames are lost without providing extensive buffering (which would consume a large amount of memory and which would also substantially degrade real time capabilities of the audio coding) it is desirable to have concepts to deal with a loss of one or more audio frames. In particular, it is desirable to have concepts which bring along a good audio quality, or at least an acceptable audio quality, even in the case that audio frames are lost.

Notably, a frame loss implies that a frame has not been properly decoded (in particular, not decoded in time to be output). A frame loss can occur when a frame is completely undetected, or when a frame arrives too late, or in case that a bit error is detected (for that reason, the frame is lost in the sense that it is not utilizable, and shall be concealed). For these failures (which can be held as being part of the class of "frame losses"), the result is that it is not possible to decode the frame and it is needed to perform an error concealment operation.

In the past, some error concealment concepts have been developed, which can be employed in different audio coding concepts.

A conventional concealment technique in advanced audio codec (AAC) is noise substitution [1]. It operates in the frequency domain and is suited for noisy and music items.

Notwithstanding, it has been acknowledged that, for speech segments, frequency domain noise substitution often produces phase discontinuities which end up in annoying "click"-artefacts in the time domain.

Therefore, an ACELP-like time domain approach can be used for speech segments (e.g., TD-TCX PLC in [2] or [3]), determined by a classifier.

One problem with time domain concealment is the artificial generated harmonicity on the full frequency range. An annoying "beep"-artefacts can be produced.

Another drawback of time domain concealment is the high computational complexity in comparison to error-free decoding or concealing with noise substitution.

3. SUMMARY

An embodiment may have an error concealment unit for providing an error concealment audio information for concealing a loss of an audio frame in an encoded audio information, wherein the error concealment unit is configured to provide a first error concealment audio information component for a first frequency range using a frequency domain concealment, wherein the error concealment unit is further configured to provide a second error concealment audio information component for a second frequency range, which includes lower frequencies than the first frequency range, using a time domain concealment, and wherein the error concealment unit is further configured to combine the first error concealment audio information component and the second error concealment audio information component, to obtain the error concealment audio information.

According to another embodiment, an audio decoder for providing a decoded audio information on the basis of encoded audio information may have an inventive error concealment unit.

According to another embodiment, an error concealment method for providing an error concealment audio information for concealing a loss of an audio frame in an encoded audio information may have the steps of: providing a first error concealment audio information component for a first frequency range using a frequency domain concealment, providing a second error concealment audio information component for a second frequency range, which includes lower frequencies than the first frequency range, using a time domain concealment, and combining the first error concealment audio information component and the second error concealment audio information component, to obtain the error concealment audio information.

Another embodiment may have a non-transitory digital storage medium having a computer program stored thereon to perform the error concealment method for providing an error concealment audio information for concealing a loss of an audio frame in an encoded audio information, the method having the steps of: providing a first error concealment audio information component for a first frequency range using a frequency domain concealment, providing a second error concealment audio information component for a second frequency range, which includes lower frequencies than the first frequency range, using a time domain concealment, and combining the first error concealment audio information component and the second error concealment audio information component, to obtain the error concealment audio information, when said computer program is run by a computer.

According to another embodiment, an audio encoder for providing an encoded audio representation on the basis of an input audio information may have: a frequency domain encoder configured to provide an encoded frequency domain representation on the basis of the input audio information, and/or a linear-prediction-domain encoder configured to provide an encoded linear-prediction-domain representation on the basis of the input audio information;

and a crossover frequency determinator configured to determine a crossover frequency information which defines a crossover frequency between a time domain error concealment and a frequency domain error concealment to be used at the side of an audio decoder; wherein the audio encoder is configured to include the encoded frequency domain representation and/or the encoded linear-prediction-domain representation and also the crossover frequency information into the encoded audio representation.

According to another embodiment, a method for providing an encoded audio representation on the basis of an input audio information may have the following steps: a frequency domain encoding step to provide an encoded frequency domain representation on the basis of the input audio information, and/or a linear-prediction-domain encoding step to provide an encoded linear-prediction-domain representation on the basis of the input audio information; and a crossover frequency determining step to determine a crossover frequency information which defines a crossover frequency between a time domain error concealment and a frequency domain error concealment to be used at the side of an audio decoder; wherein the encoded frequency domain representation and/or the encoded linear-prediction-domain representation and also the crossover frequency information are included into the encoded audio representation.

According to another embodiment, an encoded audio representation may have: an encoded frequency domain representation representing an audio content, and/or an encoded linear-prediction-domain representation representing an audio content; and a crossover frequency information which defines a crossover frequency between a time domain error concealment and a frequency domain error concealment to be used at the side of an audio decoder.

According to another embodiment, a system may have: an inventive audio encoder; an audio decoder for providing a decoded audio information on the basis of encoded audio information, the audio decoder including an error concealment unit for providing an error concealment audio information for concealing a loss of an audio frame in an encoded audio information, wherein the error concealment unit is configured to provide a first error concealment audio information component for a first frequency range using a frequency domain concealment, wherein the error concealment unit is further configured to provide a second error concealment audio information component for a second frequency range, which includes lower frequencies than the first frequency range, using a time domain concealment, and wherein the error concealment unit is further configured to combine the first error concealment audio information component and the second error concealment audio information component, to obtain the error concealment audio information; wherein the error concealment unit is configured to perform a control to determine and/or signal-adaptively vary the first and/or second frequency ranges; wherein the control is configured to determine the first and second frequency ranges on the basis of the crossover frequency information provided by the audio encoder.

Another embodiment may have a non-transitory digital storage medium having a computer program stored thereon to perform the method for providing an encoded audio representation on the basis of an input audio information, the method having the following steps: a frequency domain encoding step to provide an encoded frequency domain representation on the basis of the input audio information, and/or a linear-prediction-domain encoding step to provide an encoded linear-prediction-domain representation on the basis of the input audio information; and a crossover frequency determining step to determine a crossover frequency information which defines a crossover frequency between a time domain error concealment and a frequency domain error concealment to be used at the side of an audio decoder; wherein the encoded frequency domain representation and/or the encoded linear-prediction-domain representation and also the crossover frequency information are included into the encoded audio representation, when said computer program is run by a computer.

Another embodiment may have an error concealment unit for providing an error concealment audio information for concealing a loss of an audio frame in an encoded audio information, wherein the error concealment unit is configured to provide a first error concealment audio information component for a first frequency range using a frequency domain concealment, wherein the error concealment unit is further configured to provide a second error concealment audio information component for a second frequency range, which includes lower frequencies than the first frequency range, using a time domain concealment, and wherein the error concealment unit is further configured to combine the first error concealment audio information component and the second error concealment audio information component, to obtain the error concealment audio information, wherein the error concealment unit is configured to perform a control to determine and/or signal-adaptively vary the first and/or second frequency ranges.

According to another embodiment, an error concealment method for providing an error concealment audio information for concealing a loss of an audio frame in an encoded audio information may have the steps of: providing a first error concealment audio information component for a first frequency range using a frequency domain concealment, providing a second error concealment audio information component for a second frequency range, which includes lower frequencies than the first frequency range, using a time domain concealment, and combining the first error concealment audio information component and the second error concealment audio information component, to obtain the error concealment audio information, wherein the method includes signal-adaptively controlling the first and second frequency ranges.

According to the invention, there is provided an error concealment unit for providing an error concealment audio information for concealing a loss of an audio frame in an encoded audio information. The error concealment unit is configured to provide a first error concealment audio information component for a first frequency range using a frequency domain concealment. The error concealment unit is further configured to provide a second error concealment audio information component for a second frequency range, which comprises lower frequencies than the first frequency range, using a time domain concealment. The error concealment unit is further configured to combine the first error concealment audio information component and the second error concealment audio information component, to obtain the error concealment audio information (wherein additional information regarding the error concealment may optionally also be provided).

By using a frequency domain concealment for high frequencies (mostly noise) and time domain concealment for low frequencies (mostly speech), the artificial generated strong harmonicity for noise (that would be implied by using the time domain concealment over the full frequency range) is avoided, and the above-mentioned click artefacts (that would be implied by using the frequency domain concealment over the full frequency range) and beep artefacts (that would be implied by using the time domain concealment over the full frequency range) can also be avoided or reduced.

Furthermore, the computational complexity (that is implied when the time domain concealment is used over the full frequency range) is also reduced.

In particular, the problem of the artificial generated harmonicity on the full frequency range is solved. If the signal had only strong harmonics in lower frequencies (for speech items this is usually up to around 4 kHz), where background noise is in the higher frequencies, the generated harmonics up to Nyquist frequency would produce annoying "beep"-artefacts. With the present invention, this problem is extremely reduced or, in most cases, is solved.

According to an aspect of the invention, the error concealment unit is configured such that the first error concealment audio information component represents a high frequency portion of a given lost audio frame, and such that the second error concealment audio information component represents a low frequency portion of the given lost audio frame, such that error concealment audio information associated with the given lost audio frame is obtained using both the frequency domain concealment and the time domain concealment.

According to an aspect of the invention, the error concealment unit is configured to derive the first error concealment audio information component using a transform domain representation of a high frequency portion of a properly decoded audio frame preceding a lost audio frame, and/or the error concealment unit is configured to derive the second error concealment audio information component using a time domain signal synthesis on the basis of a low frequency portion of the properly decoded audio frame preceding the lost audio frame.

According to an aspect of the invention, the error concealment unit is configured to use a scaled or unscaled copy of the transform domain representation of the high frequency portion of the properly decoded audio frame preceding the lost audio frame, to obtain a transform domain representation of the high frequency portion of the lost audio frame, and to convert the transform domain representation of the high frequency portion of the lost audio frame into the time domain, to obtain a time domain signal component which is the first error concealment audio information component.

According to an aspect of the invention, the error concealment unit is configured to obtain one or more synthesis stimulus parameters and one or more synthesis filter parameters on the basis of the low frequency portion of the properly decoded audio frame preceding the lost audio frame, and to obtain the second error concealment audio information component using a signal synthesis, stimulus parameters and filter parameters of which signal synthesis are derived on the basis of the obtained synthesis stimulus parameters and the obtained synthesis filter parameters or equal to the obtained synthesis stimulus parameters and the obtained synthesis filter parameters.

According to an aspect of the invention, the error concealment unit is configured to perform a control to determine and/or signal-adaptively vary the first and/or second frequency ranges.

Accordingly, a user or a control application can select the frequency ranges. Further, it is possible to modify the concealment according to the decoded signals.

According to an aspect of the invention, the error concealment unit is configured to perform the control on the basis of characteristics chosen between characteristics of one or more encoded audio frames and characteristics of one or more properly decoded audio frames.

Accordingly, it is possible to adapt the frequency ranges to the characteristics of the signal.

According to an aspect of the invention, the error concealment unit is configured to obtain an information about a harmonicity of one or more properly decoded audio frames and to perform the control on the basis of the information on the harmonicity. In addition or in alternative, the error concealment unit is configured to obtain an information about a spectral tilt of one or more properly decoded audio frames and to perform the control on the basis of the information about the spectral tilt.

Accordingly, it is possible to perform special operations. For example, where the energy tilt of the harmonics is constant over the frequencies, it can be advantageous to carry out a full frequency time domain concealment (no frequency domain concealment at all). A full spectrum frequency domain concealment (no time domain concealment at all) can be advantageous where the signal contains no harmonicity.

According to an aspect of the invention, it is possible to render the harmonicity comparatively smaller in the first frequency range (mostly noise) when compared to the harmonicity in the second frequency range (mostly speech).

According to an aspect of the invention, the error concealment unit is configured to determine up to which frequency the properly decoded audio frame preceding the lost audio frame comprises a harmonicity which is stronger than a harmonicity threshold, and to choose the first frequency range and the second frequency range in dependence thereon.

By using the comparison with the threshold, it is possible, for example, to distinguish noise from speech and to determine the frequencies to be concealed using time domain concealment and the frequencies to be concealed using frequency domain concealment.

According to an aspect of the invention, the error concealment unit is configured to determine or estimate a frequency border at which a spectral tilt of the properly decoded audio frame preceding the lost audio frame changes from a smaller spectral tilt to a larger spectral tilt, and to choose the first frequency range and the second frequency range in dependence thereon.

It is possible to intend that with a small spectral tilt a fairly (or at least prevalently) flat frequency response occurs, while with a large spectral tilt the signal has either much more energy in the low band than in the high band or the other way around.

In other words, a small (or smaller) spectral tilt can mean that the frequency response is "fairly" flat, whereas with a large (or larger) spectral tilt the signal has either (much) more energy (e.g. per spectral bin or per frequency interval) in the low band than in the high band, or the other way around.

It is also possible to perform a basic (non-complex) spectral tilt estimation to obtain a trend of the energy of the frequency band which can be a first order function (e.g., that can be represented by a line). In this case, it is possible to detect a region where energy (for example, average band energy) is lower than a certain (predetermined) threshold.

In the case the low band has almost no energy but the high band has then it is possible to use FD (e.g,. frequency-domain-concealment) only in some embodiments.

According to an aspect of the invention, the error concealment unit is configured to adjust the first (generally higher) frequency range and the second (generally lower) frequency range, such that the first frequency range covers a spectral region which comprises a noise-like spectral structure, and such that the second frequency range covers a spectral region which comprises a harmonic spectral structure.

Accordingly, it is possible to use different concealment techniques for speech and noise.

According to an aspect of the invention, the error concealment unit is configured to perform a control so as to adapt a lower frequency end of the first frequency range and/or a higher frequency end of the second frequency range in dependence on an energy relationship between harmonics and noise.

By analysing the energy relationship between harmonics and noise, it is possible to determine, with a good degree of certainty, the frequencies to be processed using time domain concealment and the frequencies to be processed using frequency domain concealment.

According to an aspect of the invention, the error concealment unit is configured to perform a control so as to selectively inhibit at least one of the time domain concealment and frequency domain concealment and/or to perform time domain concealment only or the frequency domain concealment only to obtain the error concealment audio information.

This property permits to perform special operations. For example, it is possible to selectively inhibit the frequency domain concealment when the energy tilt of the harmonics is constant over the frequencies. The time domain concealment can be inhibited when the signal contains no harmonicity (mostly noise).

According to an aspect of the invention, the error concealment unit is configured to determine or estimate whether a variation of a spectral tilt of the properly decoded audio frame preceding the lost audio frame is smaller than a predetermined spectral tilt threshold over a given frequency range, and to obtain the error concealment audio information using the time-domain concealment only if it is found that the variation of a spectral tilt of the properly decoded audio frame preceding the lost audio frame is smaller than the predetermined spectral tilt threshold.

Accordingly, it is possible to have an easy technique to determine whether to only operate with time domain concealment by observing the evolution of the spectral tilt.

According to an aspect of the invention, the error concealment unit is configured to determine or estimate whether a harmonicity of the properly decoded audio frame preceding the lost audio frame is smaller than a predetermined harmonicity threshold, and to obtain the error concealment audio information using the frequency domain concealment only if it is found that the harmonicity of the properly decoded audio frame preceding the lost audio frame is smaller than the predetermined harmonicity threshold.

Accordingly, it is possible to provide a solution to determine whether to operate with frequency domain concealment only by observing the evolution of the harmonicity.

According to an aspect of the invention, the error concealment unit is configured to adapt a pitch of a concealed frame based on a pitch of a properly decoded audio frame preceding a lost audio frame and/or in dependence of a temporal evolution of the pitch in the properly decoded audio frame preceding the lost audio frame, and/or in dependence on an interpolation of the pitch between the properly decoded audio frame preceding the lost audio frame and a properly decoded audio frame following the lost audio frame.

If the pitch is known for every frame, it is possible to vary the pitch inside the concealed frame based on the past pitch value.

According to an aspect of the invention, the error concealment unit is configured to perform the control on the basis of information transmitted by an encoder.

According to an aspect of the invention, the error concealment unit is further configured to combine the first error concealment audio information component and the second error concealment audio information component using an overlap-and-add, OLA, mechanism.

Accordingly, it is possible to easily perform the combination between the two components of the error concealment audio information between the first component and the second component.

According to an aspect of the invention, the error concealment unit is configured to perform an inverse modified discrete cosine transform (IMDCT) on the basis of a spectral domain representation obtained by the frequency domain error concealment, in order to obtain a time domain representation of the first error concealment audio information component.

Accordingly, it is possible to provide a useful interface between the frequency domain concealment and the time domain concealment.

According to an aspect of the invention, the error concealment unit is configured to provide the second error concealment audio information component such that the second error concealment audio information component comprises a temporal duration which is at least 25 percent longer than the lost audio frame, to allow for an overlap-and-add. According to an aspect of the invention, the error concealment unit can be configured to perform an IMDCT twice to get two consecutive frames in the time domain.

To combine the lower and high frequency parts or paths, the OLA mechanism is performed in the time domain. For AAC-like codec, this means that more than one frame (typically one and a half frames) have to be updated for one concealed frame. That's because the analysis and synthesis method of the OLA has a half frame delay. When an inverse modified discrete cosine transform (IMDCT) is used, the IMDCT produces only one frame: therefore an additional half frame is needed. Thus, the IMDCT can be called twice to get two consecutive frames in the time domain.

Notably, if the frame length consists of a predetermined number of samples (e.g., 1024 samples) for AAC, at the encoder the MDCT transform consists of first applying a window that is twice the frame length. At the decoder after an MDCT and before an overlap and add operation, the number of samples is also double (e.g., 2048). These samples contain aliasing. In this case, it is after the overlap and add with a previous frame that aliasing is cancelled for the left part (1024 samples). The later correspond to the frame that would be played out by the decoder.

According to an aspect of the invention, the error concealment unit is configured to perform a high pass filtering of the first error concealment audio information component, downstream of the frequency domain concealment.

Accordingly, it is possible to obtain, with a good degree of reliability, the high frequency component of the concealment information.

According to an aspect of the invention, the error concealment unit is configured to perform a high pass filtering with a cutoff frequency between 6 KHz and 10 KHz, advantageously 7 KHz and 9 KHz, more advantageously between 7.5 KHz and 8.5 KHz, even more advantageously between 7.9 KHz and 8.1 KHz, and even more advantageously 8 KHz.

This frequency has been proven particularly adapted for distinguishing noise from speech.

According to an aspect of the invention, the error concealment unit is configured to signal-adaptively adjust a lower frequency boundary of the high-pass filtering, to thereby vary a bandwidth of the first frequency range.

Accordingly, it is possible to cut (in any situation) the noise frequencies from the speech frequencies. Since to get such filters (HP and LP) that cut with precision are usually too complex, then in practice the cut off frequency is well defined (even if the attenuation could also not be perfect for the frequencies above or below).

According to an aspect of the invention, the error concealment unit is configured to down-sample a time-domain representation of an audio frame preceding the lost audio frame, in order to obtain a down-sampled time-domain representation of the audio frame preceding the lost audio frame which down-sampled time-domain representation only represents a low frequency portion of the audio frame preceding the lost audio frame, and to perform the time domain concealment using the down-sampled time-domain representation of the audio frame preceding the lost audio frame, and to up-sample a concealed audio information provided by the time domain concealment, or a post-processed version thereof, in order to obtain the second error concealment audio information component, such that the time domain concealment is performed using a sampling frequency which is smaller than a sampling frequency involved to fully represent the audio frame preceding the lost audio frame. The up-sampled second error concealment audio information component can then be combined with the first error concealment audio information component.

By operating in a downsampled environment, the time domain concealment has a reduced computational complexity.

According to an aspect of the invention, the error concealment unit is configured to signal-adaptively adjust a sampling rate of the down-sampled time-domain representation, to thereby vary a bandwidth of the second frequency range.

Accordingly, it is possible to vary the sampling rate of the down-sampled time-domain representation to the appropriate frequency, in particular when conditions of the signal vary (for example, when a particular signal needs to increase the sampling rate). Accordingly, it is possible to obtain the advantageous sampling rate, e.g. for the purpose of separating noise from speech.

According to an aspect of the invention, the error concealment unit is configured to perform a fade out using a damping factor.

Accordingly, it is possible to gracefully degrade the subsequent concealed frames to reduce their intensity.

Usually, we do fade out when there are more than one frame loss. Most of the time we already apply some sort of fade out on the first frame loss but the most important part is to fade out nicely to silence or background noise if we have burst of error (multiple frames loss in a row).

According to a further aspect of the invention, the error concealment unit is configured to scale a spectral representation of the audio frame preceding the lost audio frame using the damping factor, in order to derive the first error concealment audio information component.

It has been noted that such a strategy permits to achieve a graceful degradation particularly adapted to the invention.

According to an aspect of the invention, the error concealment is configured to low-pass filter an output signal of the time domain concealment, or an up-sampled version thereof, in order to obtain the second error concealment audio information component.

In this way, it is possible to achieve an easy but reliable way to obtain that the second error concealment audio information component is in a low frequency range.

The invention is also directed to an audio decoder for providing a decoded audio information on the basis of encoded audio information, the audio decoder comprising an error concealment unit according to any of the aspects indicated above.

According to an aspect of the invention, the audio decoder is configured to obtain a spectral domain representation of an audio frame on the basis of an encoded representation of the spectral domain representation of the audio frame, and wherein the audio decoder is configured to perform a spectral-domain-to-time-domain conversion, in order to obtain a decoded time representation of the audio frame. The error concealment is configured to perform the frequency domain concealment using of a spectral domain representation of a properly decoded audio frame preceding a lost audio frame, or a portion thereof. The error concealment is configured to perform the time domain concealment using a decoded time domain representation of a properly decoded audio frame preceding the lost audio frame.

The invention also relates to an error concealment method for providing an error concealment audio information for concealing a loss of an audio frame in an encoded audio information, the method comprising:

- providing a first error concealment audio information component for a first frequency range using a frequency domain concealment,
- providing a second error concealment audio information component for a second frequency range, which comprises lower frequencies than the first frequency range, using a time domain concealment, and
- combining the first error concealment audio information component and the second error concealment audio information component, to obtain the error concealment audio information.

The inventive method can also comprise signal-adaptively controlling the first and second frequency ranges. The method can also comprise adaptively switching to a mode in which only a time domain concealment or only a frequency domain concealment is used to obtain an error concealment audio information for at least one lost audio frame.

The invention also relates to a computer program for performing the inventive method when the computer program runs on a computer and/or for controlling the inventive error concealment unit and/or the inventive decoder.

The invention also relates to an audio encoder for providing an encoded audio representation on the basis of an input audio information. The audio encoder comprises: a frequency domain encoder configured to provide an encoded frequency domain representation on the basis of the input audio information, and/or a linear-prediction-domain encoder configured to provide an encoded linear-prediction-domain representation on the basis of the input audio information; and a crossover frequency determinator configured to determine a crossover frequency information which defines a crossover frequency between a time domain error concealment and a frequency domain error concealment to be used at the side of an audio decoder. The audio encoder is configured to include the encoded frequency domain representation and/or the encoded linear-prediction-domain representation and also the crossover frequency information into the encoded audio representation.

Accordingly, it is not needed to recognize the first and second frequency ranges at the decoder side. This information can be easily provided by the encoder.

However, the audio encoder may, for example, rely on the same concepts for determining the crossover frequency like the audio decoder (wherein the input audio signal may be used instead of the decoded audio information).

The invention also relates to a method for providing an encoded audio representation on the basis of an input audio information. The method comprises:

- a frequency domain encoding step to provide an encoded frequency domain representation on the basis of the input audio information, and/or a linear-prediction-domain encoding step to provide an encoded linear-prediction-domain representation on the basis of the input audio information; and
- a crossover frequency determining step to determine a crossover frequency information which defines a crossover frequency between a time domain error concealment and a frequency domain error concealment to be used at the side of an audio decoder.

The encoding step is configured to include the encoded frequency domain representation and/or the encoded linear-prediction-domain representation and also the crossover frequency information into the encoded audio representation.

The invention also relates to an encoded audio representation comprising: an encoded frequency domain representation representing an audio content, and/or an encoded linear-prediction-domain representation representing an audio content; and a crossover frequency information which defines a crossover frequency between a time domain error concealment and a frequency domain error concealment to be used at the side of an audio decoder.

Accordingly, it is possible to simply transmit audio data which include (e.g., in their bitstream) information related to the first and second frequency ranges or to the boundary between the first and second frequency ranges. The decoder receiving the encoded audio representation can therefore simply adapt the frequency ranges for the FD concealment and the TD concealment to instructions provided by the encoder.

The invention also relates to a system comprising an audio encoder as mentioned above and an audio decoder as mentioned above. A control can be configured to determine the first and second frequency ranges on the basis of the crossover frequency information provided by the audio encoder.

Accordingly, the decoder can adaptively modify the frequency ranges of the TD and FD concealments to commands provided by the encoder.

4. BRIEF DESCRIPTION OF THE DRAWINGS

Embodiments of the present invention will be detailed subsequently referring to the appended drawings, in which.

Figure 4A:
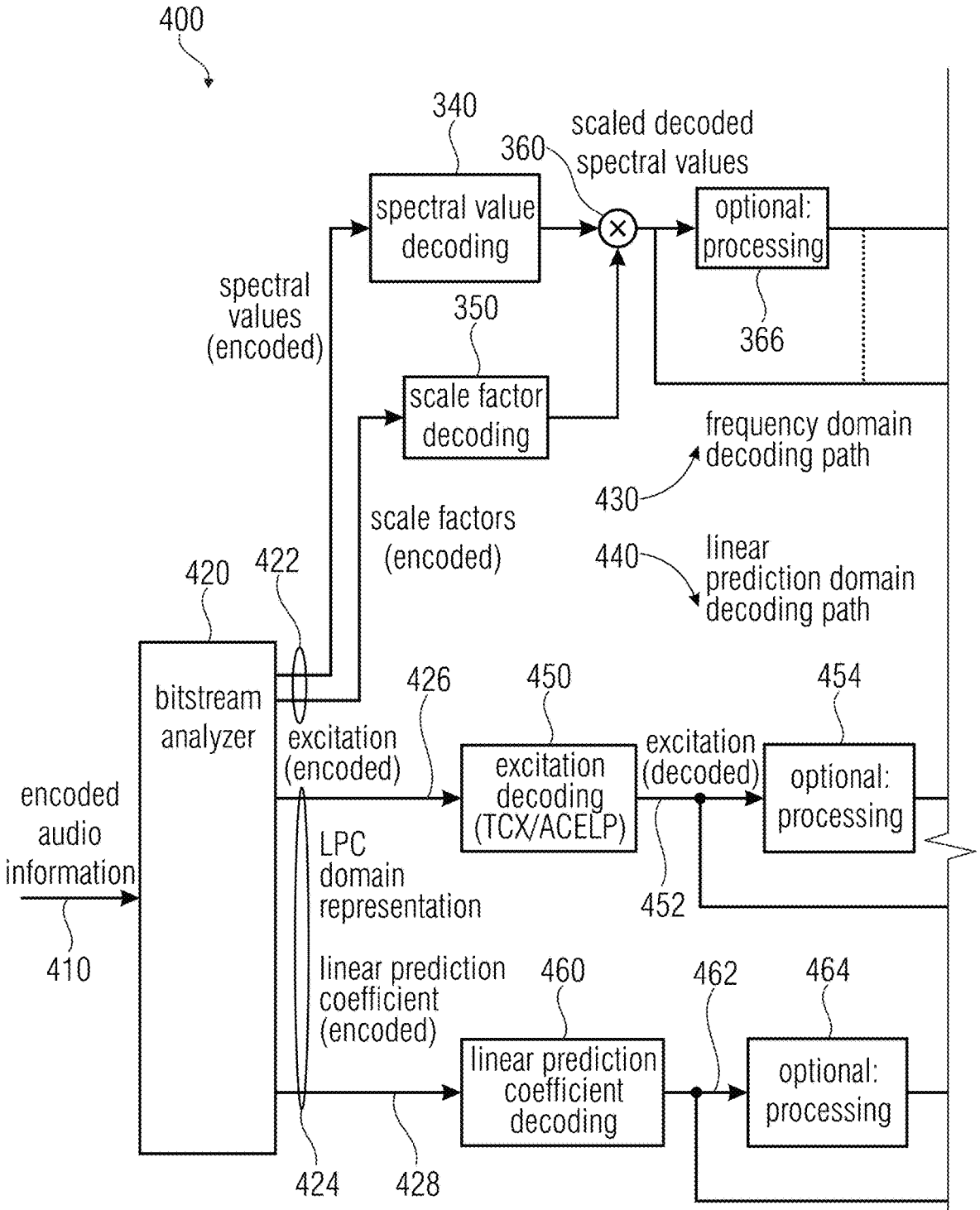
Figure 4B:
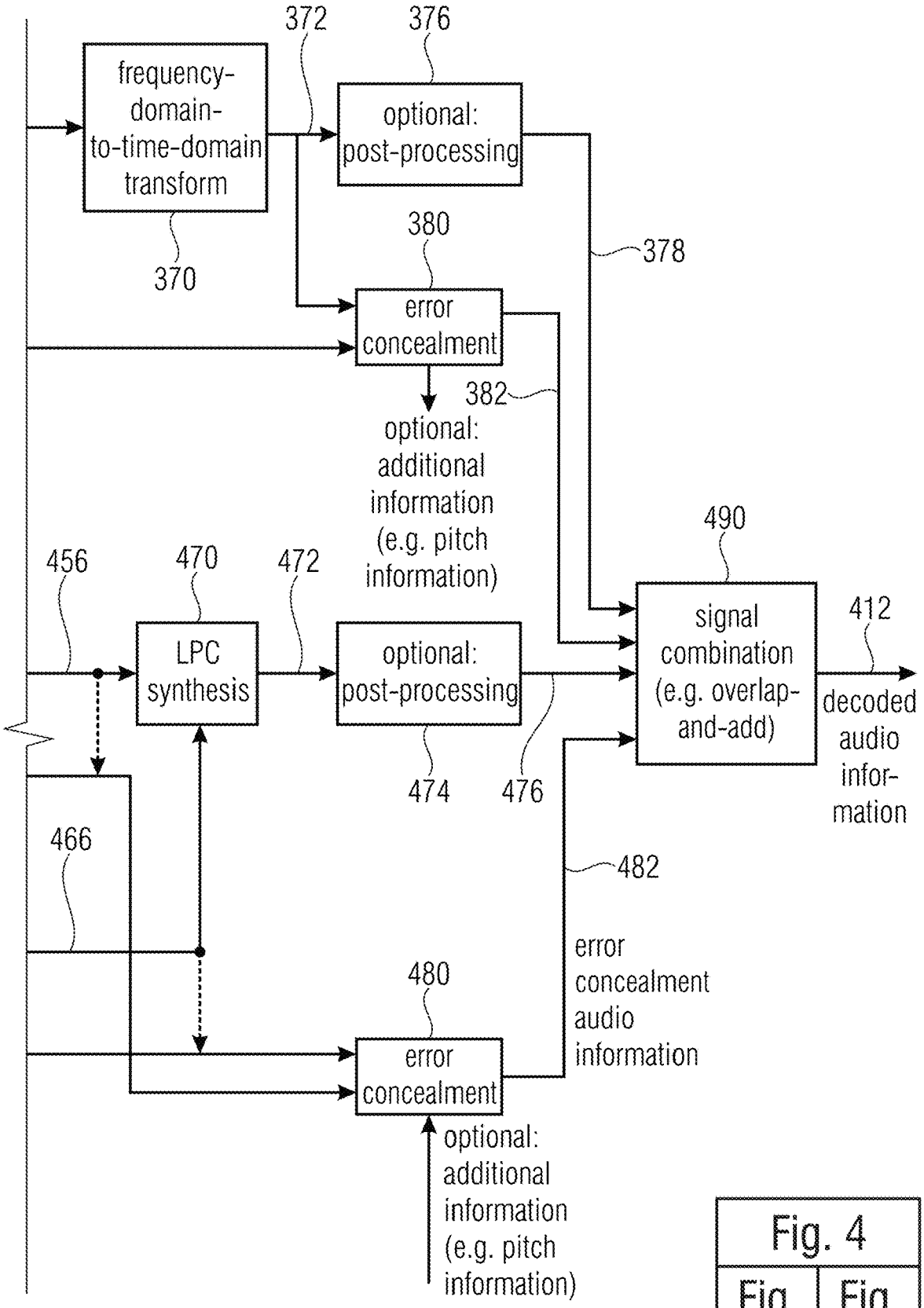
Figure 5:
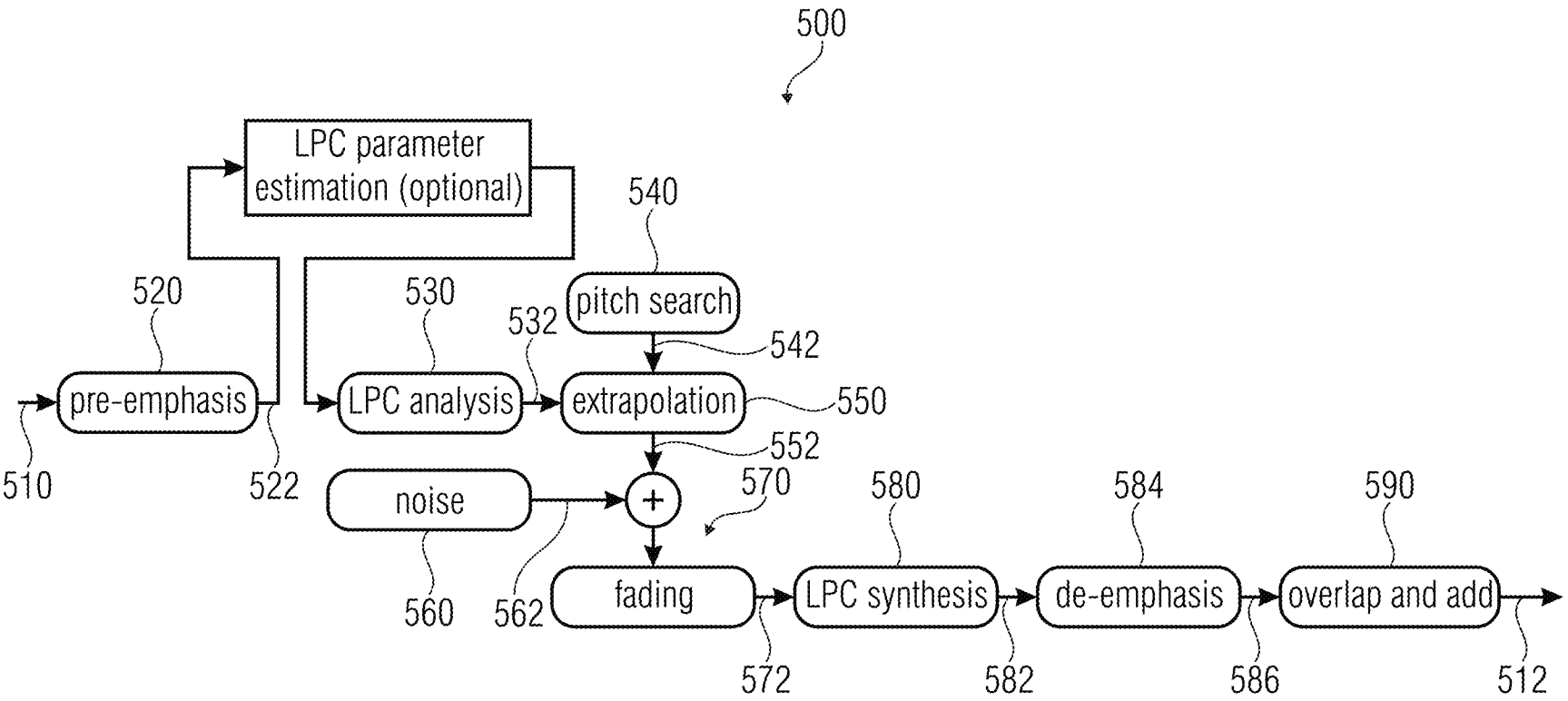
Figure 6:
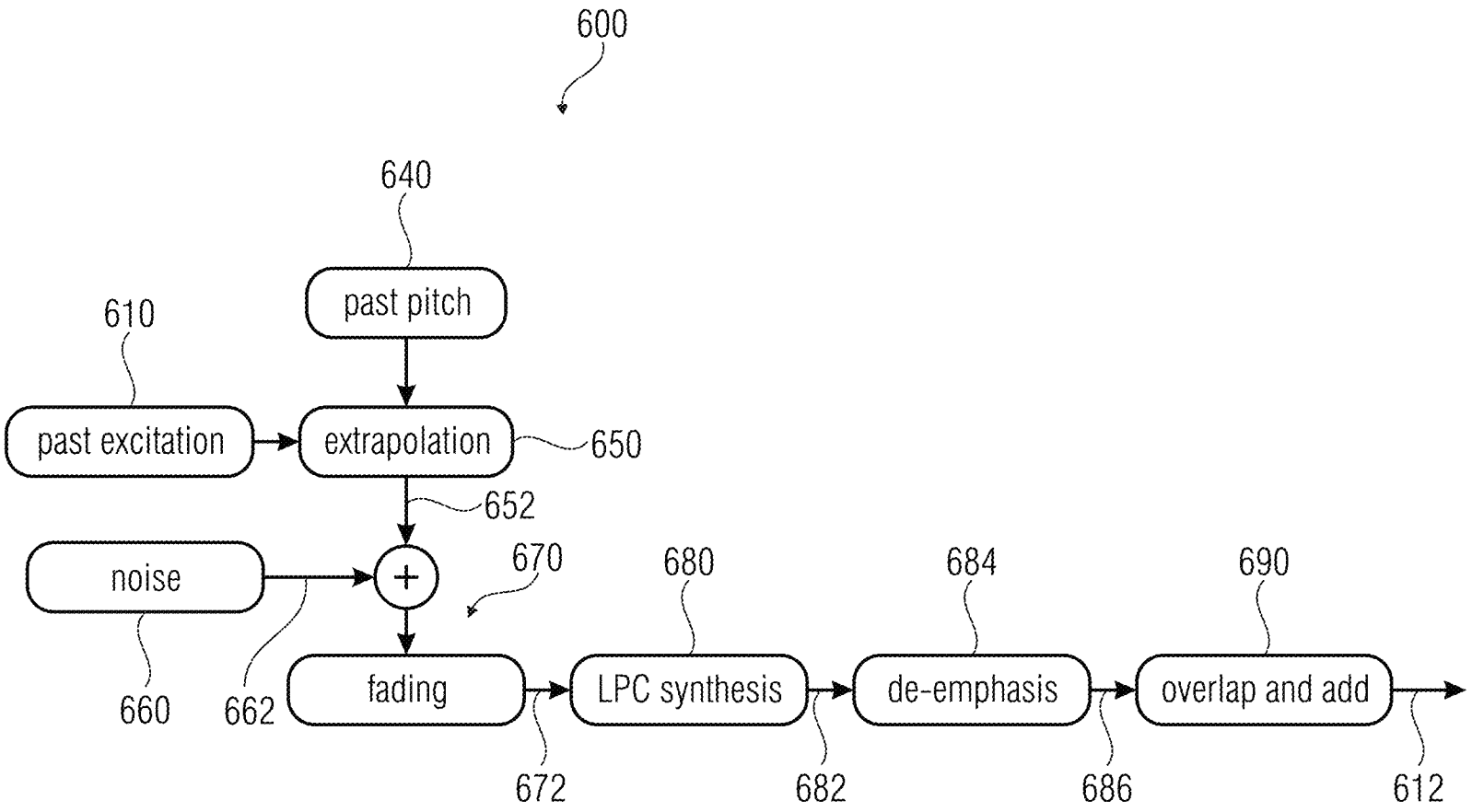
Figure 7:
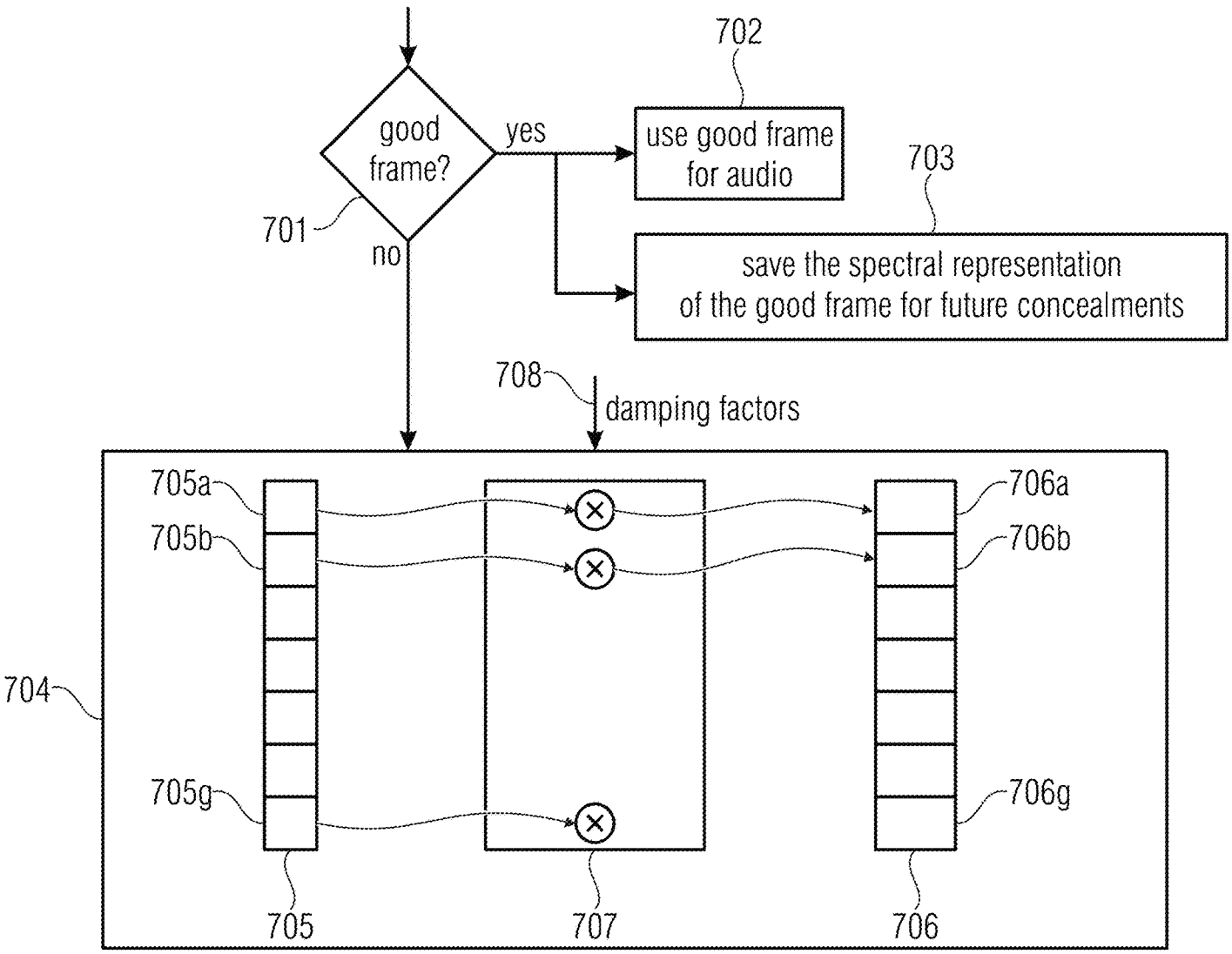
Figure 8A:
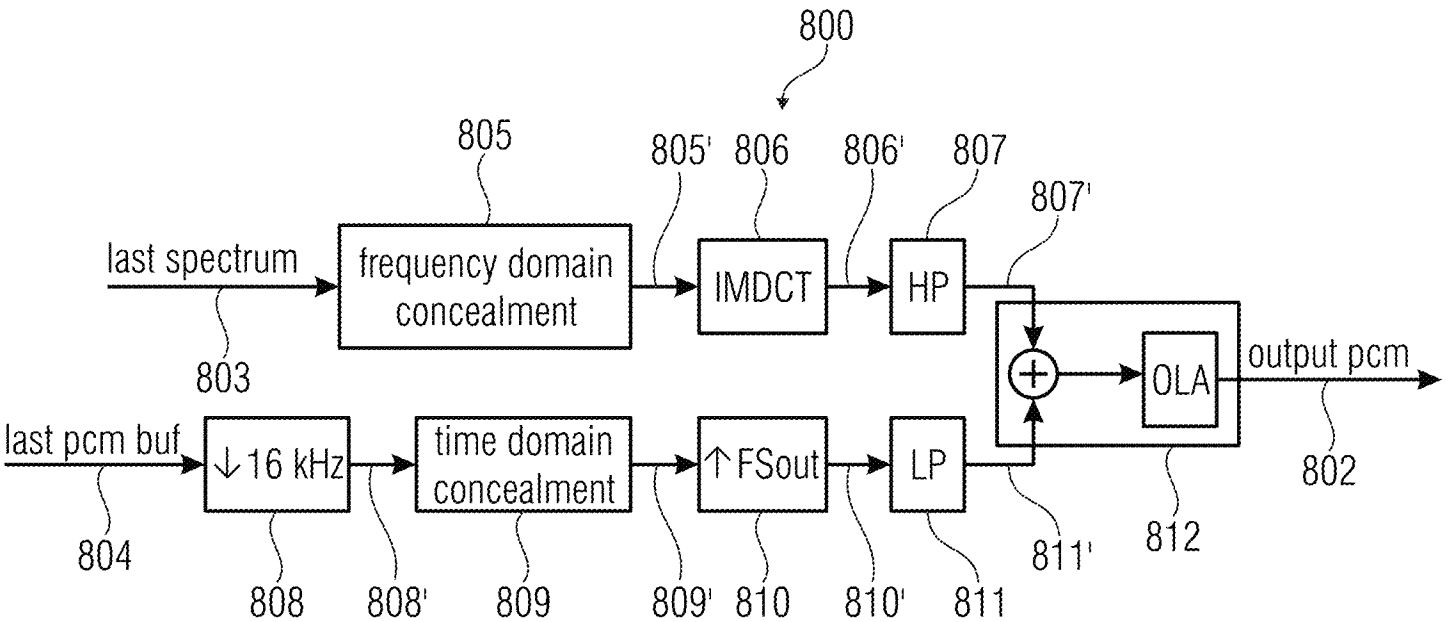
Figure 8B:
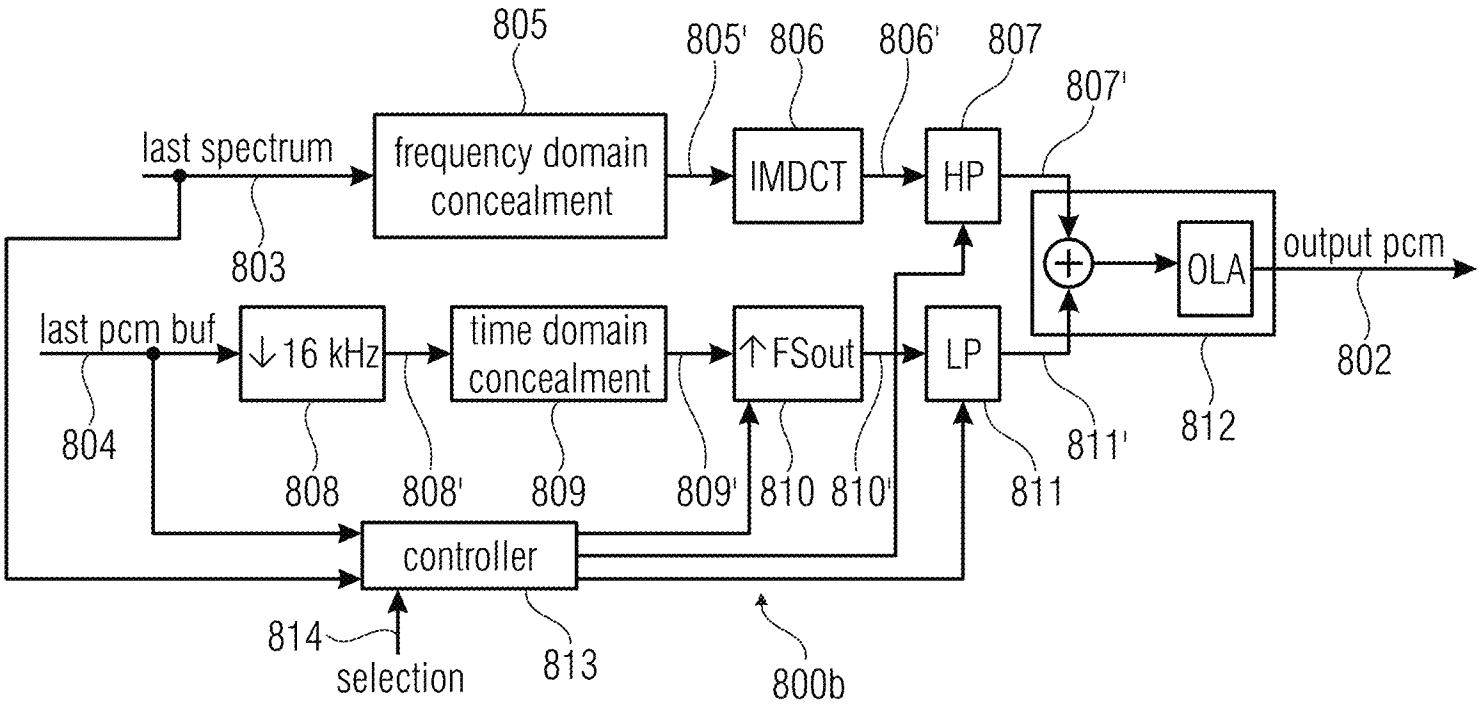
Figure 9:
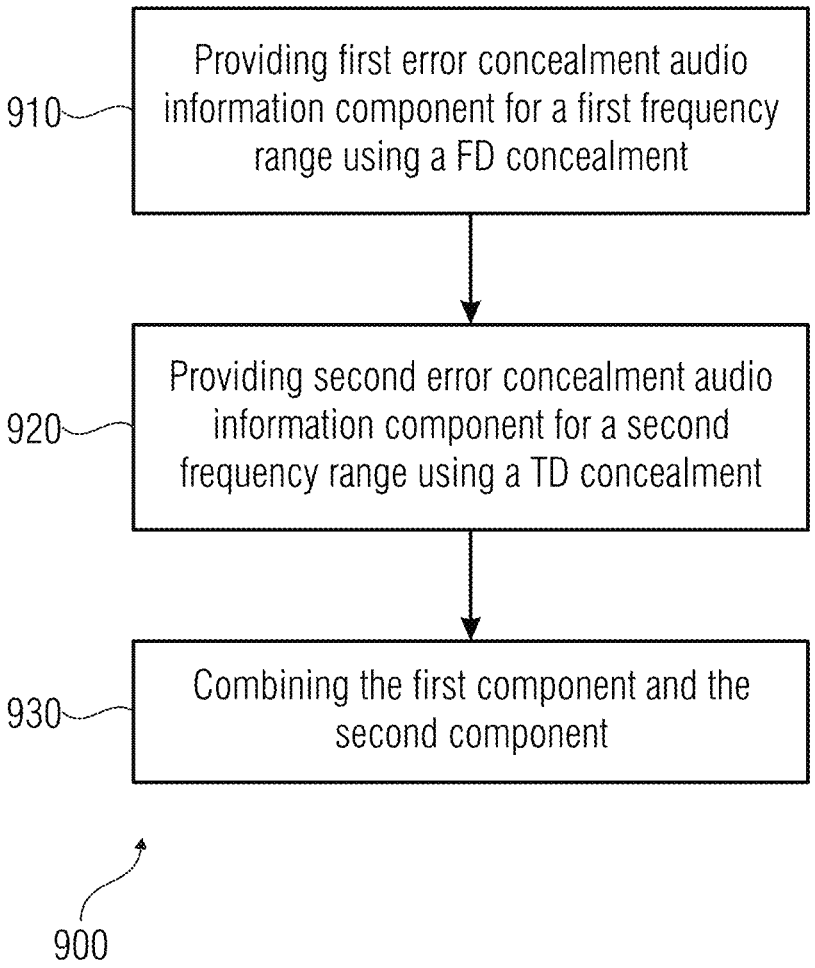
Figure 10:
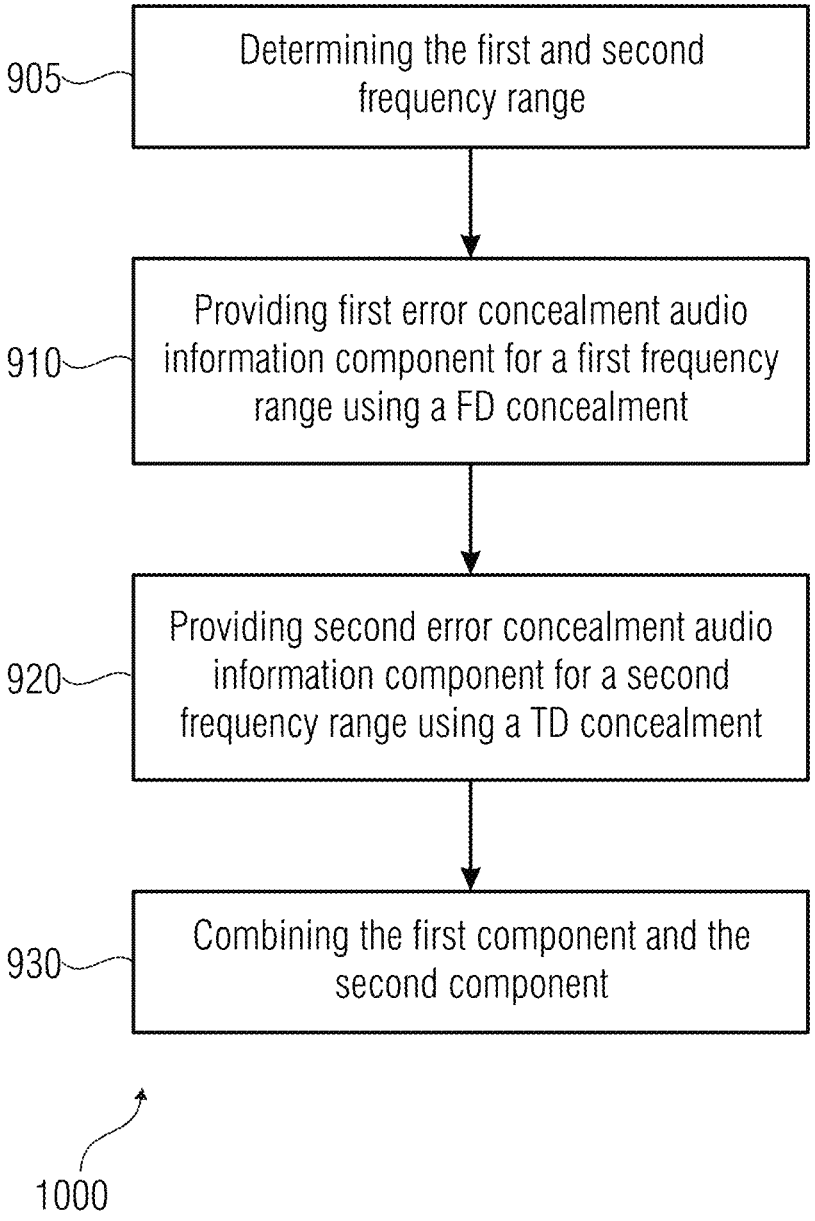
Figure 11:
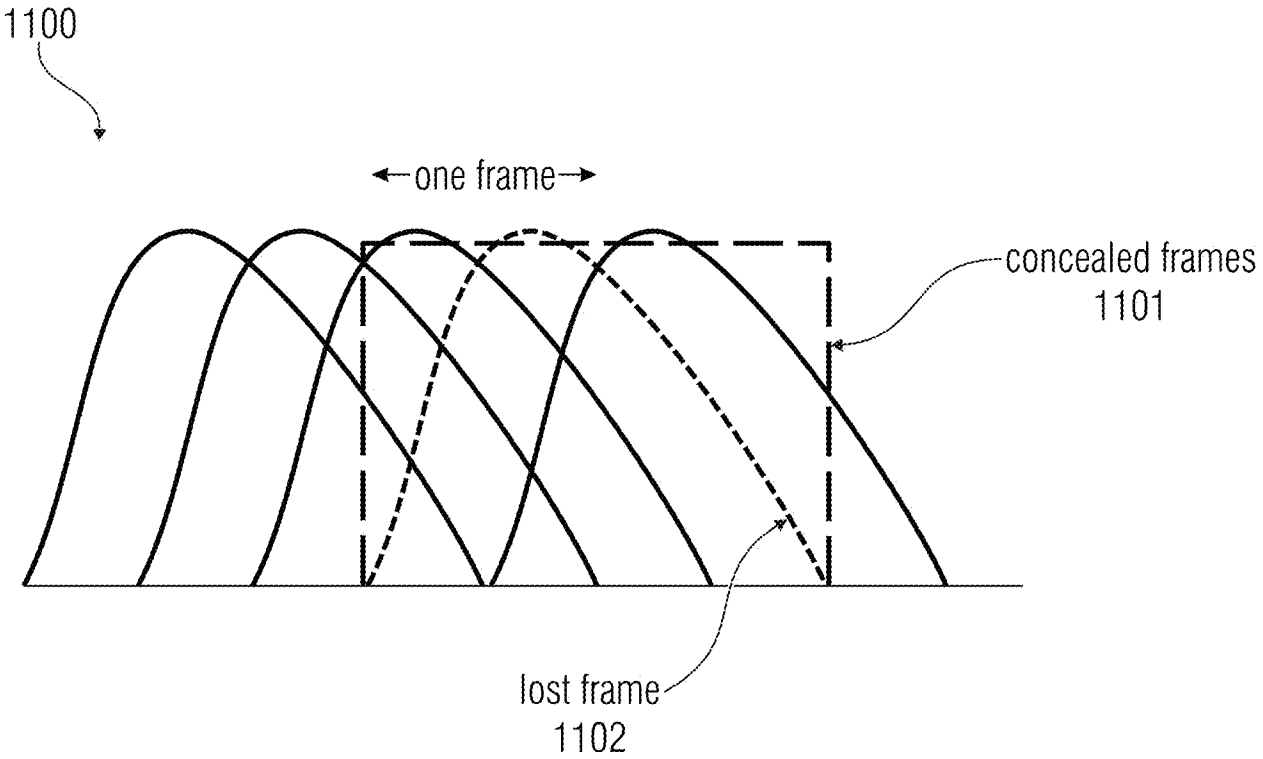
Figure 19:
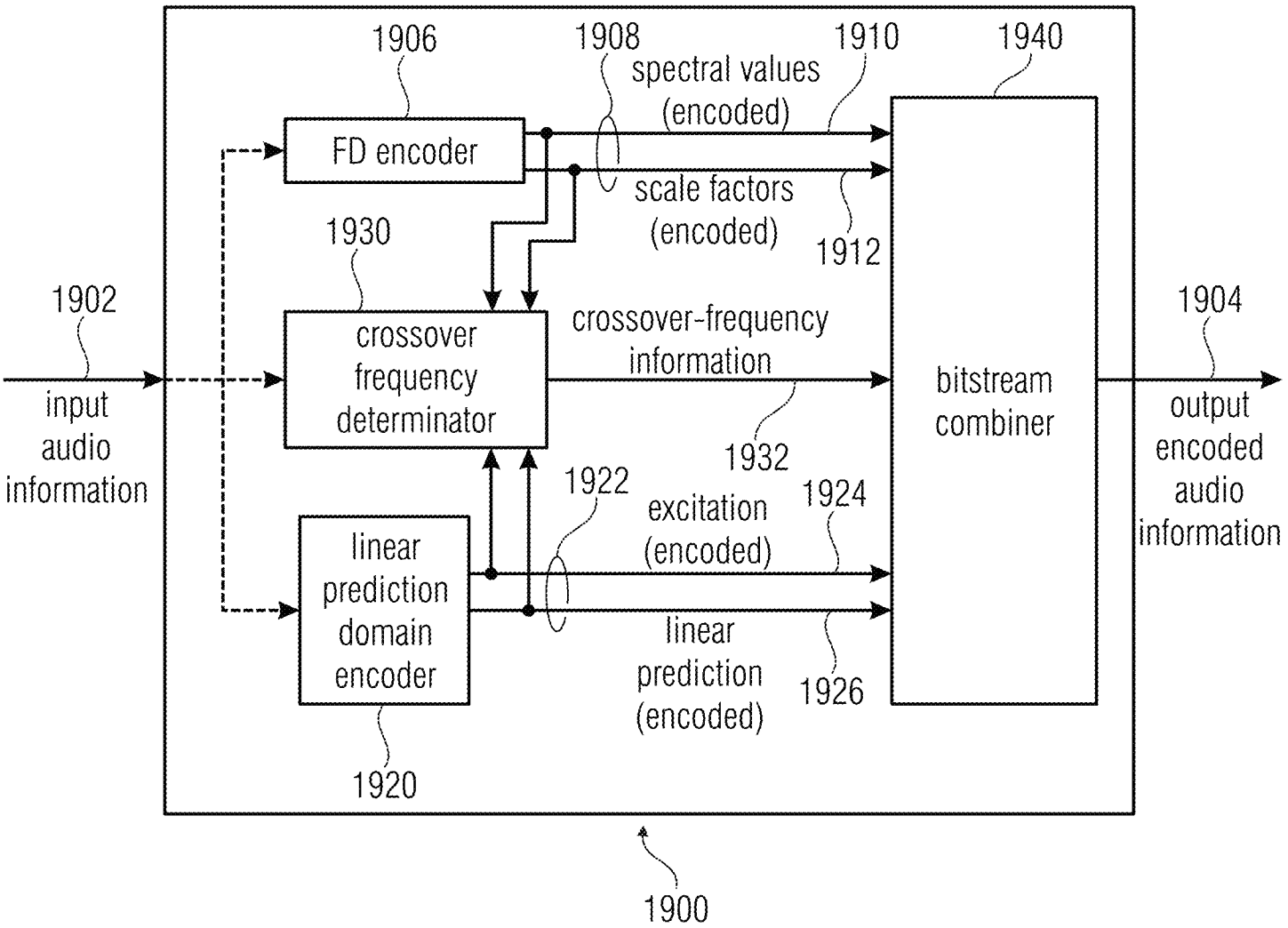
Figure 20:
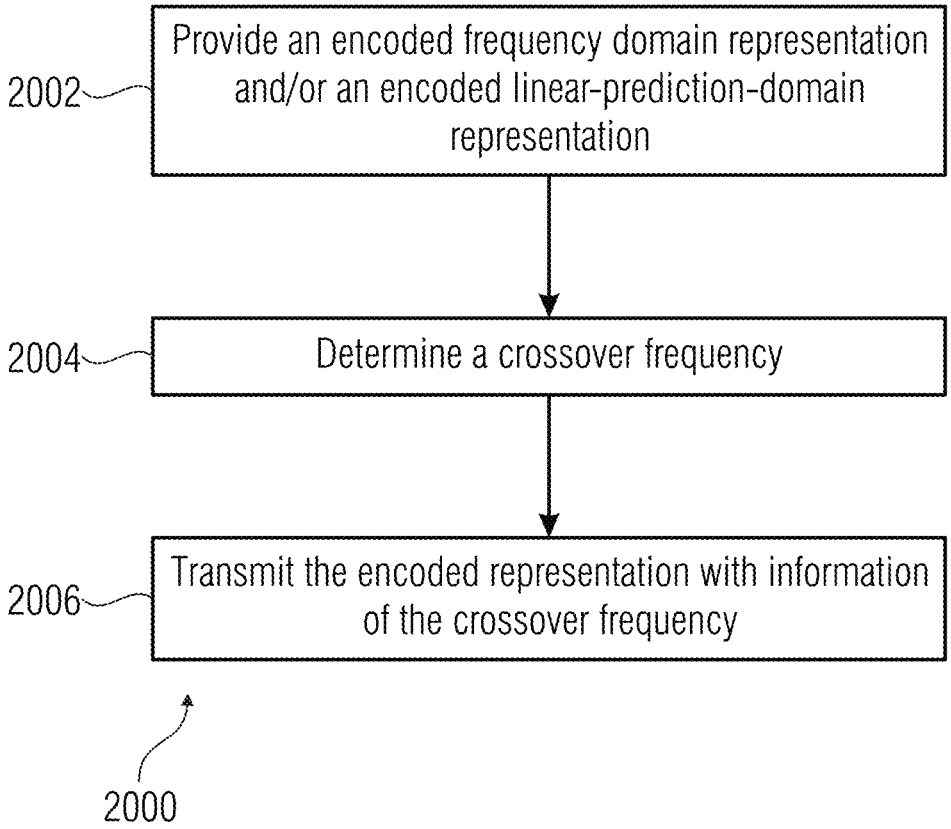

FIG. 4*a-b* is formed by FIGS. 4A and 4B and shows a block schematic diagram of an audio decoder, according to another embodiment of the present invention;

FIG. 5 shows a block schematic diagram of a time domain concealment;

FIG. 6 shows a block schematic diagram of a time domain concealment;

FIG. 7 shows a diagram illustrating an operation of frequency domain concealment;

FIG. 8*a* shows a block schematic diagram of a concealment according to an embodiment of the invention;

FIG. 8*b* shows a block schematic diagram of a concealment according to another embodiment of the invention;

FIG. 9 shows a flowchart of an inventive concealing method;

FIG. 10 shows a flowchart of an inventive concealing method;

FIG. 11 shows a particular of an operation of the invention regarding a windowing and overlap-and-add operation;

FIGS. 12-18 show comparative examples of signal diagrams;

FIG. 19 shows a block schematic diagram of an audio encoder according to an embodiment of the present invention;

FIG. 20 shows a flowchart of an inventive encoding method.

5. DETAILED DESCRIPTION OF THE INVENTION

In the present section, embodiments of the invention are discussed with reference to the drawings.

Figure 1:
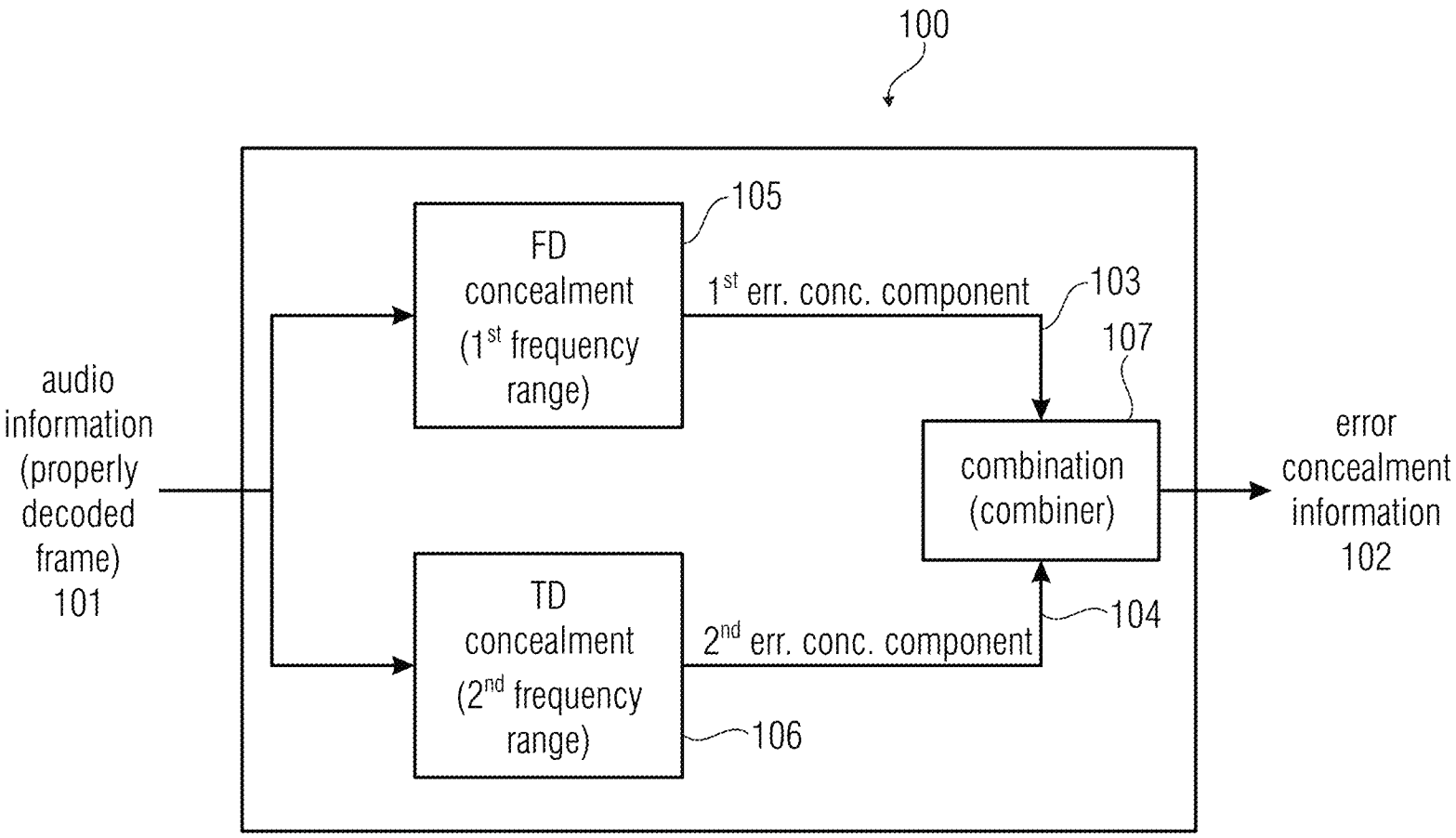
FIG. 1 shows a block schematic diagram of a concealment unit according to the invention.

5.1 Error Concealment Unit According to FIG. 1

FIG. 1 shows a block schematic diagram of an error concealment unit 100 according to the invention.

The error concealment unit 100 provides an error concealment audio information 102 for concealing a loss of an audio frame in an encoded audio information. The error concealment unit 100 is input by audio information, such as a properly decoded audio frame 101 (it is intended that the properly decoded audio frame has been decoded in the past).

The error concealment unit 100 is configured to provide (e.g., using a frequency domain concealment unit 105) a first error concealment audio information component 103 for a first frequency range using a frequency domain concealment. The error concealment unit 100 is further configured to provide (e.g., using a time domain concealment unit 106)

a second error concealment audio information component 104 for a second frequency range, using a time domain concealment. The second frequency range comprises lower frequencies than the first frequency range. The error concealment unit 100 is further configured to combine (e.g. using a combiner 107) the first error concealment audio information component 103 and the second error concealment audio information component 104 to obtain the error concealment audio information 102.

The first error concealment audio information component 103 can be intended as representing a high frequency portion (or a comparatively higher frequency portion) of a given lost audio frame. The second error concealment audio information component 104 can be intended as representing a low frequency portion (or a comparatively lower frequency portion) of the given lost audio frame. Error concealment audio information 102 associated with the lost audio frame is obtained using both the frequency domain concealment unit 105 and the time domain concealment unit 106.

5.1.1 Time Domain Error Concealment

Some information is here provided relating to a time domain concealment as can be embodied by the time domain concealment 106.

As such, a time domain concealment can, for example, be configured to modify a time domain excitation signal obtained on the basis of one or more audio frames preceding a lost audio frame, in order to obtain the second error concealment audio information component of the error concealment audio information. However, in some simple embodiments, the time domain excitation signal can be used without modification. Worded differently, the time domain concealment may obtain (or derive) a time domain excitation signal for (or on the basis of) one or more encoded audio frames preceding a lost audio frame, and may modify said time domain excitation signal, which is obtained for (or on the basis of) one or more properly received audio frames preceding a lost audio frame, to thereby obtain (by the modification) a time domain excitation signal which is used for providing the second error concealment audio information component of the error concealment audio information. In other words, the modified time domain excitation signal (or an unmodified time-domain excitation signal) may be used as an input (or as a component of an input) for a synthesis (for example, LPC synthesis) of the error concealment audio information associated with the lost audio frame (or even with multiple lost audio frames). By providing the second error concealment audio information component of the error concealment audio information on the basis of the time domain excitation signal obtained on the basis of one or more properly received audio frames preceding the lost audio frame, audible discontinuities can be avoided. On the other hand, by (optionally) modifying the time domain excitation signal derived for (or from) one or more audio frames preceding the lost audio frame, and by providing the error concealment audio information on the basis of the (optionally) modified time domain excitation signal, it is possible to consider varying characteristics of the audio content (for example, a pitch change), and it is also possible to avoid an unnatural hearing impression (for example, by "fading out" a deterministic (for example, at least approximately periodic) signal component). Thus, it can be achieved that the error concealment audio information comprises some similarity with the decoded audio information obtained on the basis of properly decoded audio frames preceding the lost audio frame, and it can still be achieved that the error concealment audio information comprises a somewhat different audio content when compared to the decoded audio information associated with the audio frame preceding the lost audio frame by somewhat modifying the time domain excitation signal. The modification of the time domain excitation signal used for the provision of the second error concealment audio information component of the error concealment audio information (associated with the lost audio frame) may, for example, comprise an amplitude scaling or a time scaling. However, other types of modification (or even a combination of an amplitude scaling and a time scaling) are possible, wherein a certain degree of relationship between the time domain excitation signal obtained (as an input information) by the error concealment and the modified time domain excitation signal should remain.

To conclude, an audio decoder allows to provide the error concealment audio information, such that the error concealment audio information provides for a good hearing impression even in the case that one or more audio frames are lost. The error concealment is performed on the basis of a time domain excitation signal, wherein a variation of the signal characteristics of the audio content during the lost audio frame may be considered by modifying the time domain excitation signal obtained on the basis of the one more audio frames preceding a lost audio frame.

5.1.2 Frequency Domain Error Concealment

Some information is here provided relating to a frequency domain concealment as can be embodied by the frequency domain concealment 105. However, in the inventive error concealment unit, the frequency domain error concealment discussed below is performed in a limited frequency range.

However, it should be noted that the frequency domain concealment described here should be considered as examples only, wherein different or more advanced concepts could also be applied. In other words, the concept described herein is used in some specific codecs, but does not need to be applied for all frequency domain decoders.

A frequency domain concealment function may, in some implementations, increase the delay of a decoder by one frame (for example, if the frequency domain concealment uses interpolation). In some implementations (or in some decoders) frequency domain concealment works on the spectral data just before the final frequency to time conversion. In case a single frame is corrupted, concealment may, for example, interpolate between the last (or one of the last) good frame (properly decoded audio frame) and the first good frame to create the spectral data for the missing frame. However, some decoders may not be able to perform an interpolation. In such a case, a more simple frequency domain concealment may be used, like, for example, an copying or an extrapolation of previously decoded spectral values. The previous frame can be processed by the frequency to time conversion, so here the missing frame to be replaced is the previous frame, the last good frame is the frame before the previous one and the first good frame is the actual frame. If multiple frames are corrupted, concealment implements first a fade out based on slightly modified spectral values from the last good frame. As soon as good frames are available, concealment fades in the new spectral data.

In the following the actual frame is frame number n, the corrupt frame to be interpolated is the frame n−1 and the last but one frame has the number n−2. The determination of window sequence and the window shape of the corrupt frame follows from the table below:

TABLE 1

Interpolated window sequences and window shapes (as used for some AAC family decoders and USAC)

| window sequence n-2 | window sequence n | window sequence n-1 | window shape n-1 |
|---|---|---|---|
| ONLY_LONG_SEQUENCE or LONG_START_SEQUENCE or LONG_STOP_SEQUENCE | ONLY_LONG_SEQUENCE or LONG_START_SEQUENCE or LONG_STOP_SEQUENCE | ONLY_LONG_SEQUENCE | 0 |
| ONLY_LONG_SEQUENCE or LONG_ START_SEQUENCE or LONG_STOP_SEQUENCE | EIGHT_SHORT_SEQUENCE | LONG_START_SEQUENCE | 1 |
| EIGHT_SHORT_SEQUENCE | EIGHT_SHORT_SEQUENCE | EIGHT_SHORT_SEQUENCE | 1 |
| EIGHT_SHORT SEQUENCE | ONLY_LONG_SEQUENCE or LONG_START_SEQUENCE or LONG_STOP_SEQUENCE | LONG_STOP_SEQUENCE | 0 |

The scalefactor band energies of frames n−2 and n are calculated. If the window sequence in one of these frames is an EIGHT_SHORT_SEQUENCE and the final window sequence for frame n−1 is one of the long transform windows, the scalefactor band energies are calculated for long block scalefactor bands by mapping the frequency line index of short block spectral coefficients to a long block representation. The new interpolated spectrum is built by reusing the spectrum of the older frame n−2 multiplying a factor to each spectral coefficient. An exception is made in the case of a short window sequence in frame n−2 and a long window sequence in frame n, here the spectrum of the actual frame n is modified by the interpolation factor. This factor is constant over the range of each scalefactor band and is derived from the scalefactor band energy differences of frames n−2 and n. Finally the sign of the interpolated spectral coefficients will be flipped randomly.

A complete fading out takes 5 frames. The spectral coefficients from the last good frame are copied and attenuated by a factor of:

$$\text{fadeOutFac}=2^{-(nFadeOutFrame/2)}$$

with nFadeOutFrameas frame counter since the last good frame.

After 5 frames of fading out the concealment switches to muting, that means the complete spectrum will be set to 0.

The decoder fades in when receiving good frames again. The fade in process takes 5 frames, too and the factor multiplied to the spectrum is:

$$\text{fadeInFac}=2^{-(5-nFadeInFrame)/2}$$

where nFadeInFrame is the frame counter since the first good frame after concealing multiple frames.

Recently, new solutions have been introduced. With respect to these systems, it is now possible to copy a frequency bin just after the decoding of the last previous good frame, and then to apply independently the other processing like TNS and/or noise filling.

Different solutions may also be used in EVS or ELD.

5.2. Audio Decoder According to FIG. 2

Figure 2:
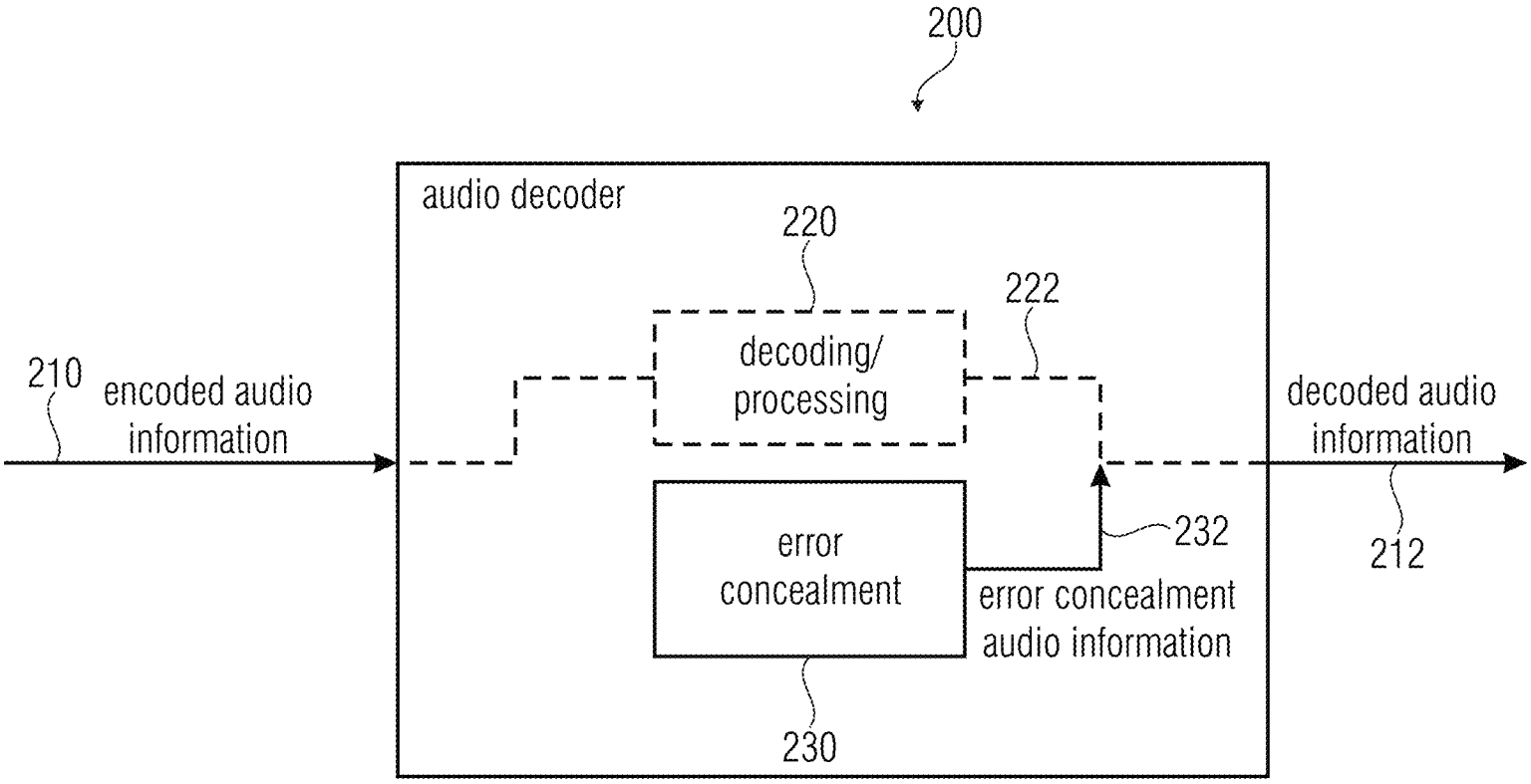
FIG. 2 shows a block schematic diagram of an audio decoder according to an embodiment of the present invention.

FIG. 2 shows a block schematic diagram of an audio decoder 200, according to an embodiment of the present invention. The audio decoder 200 receives an encoded audio information 210, which may, for example, comprise an audio frame encoded in a frequency-domain representation. The encoded audio information 210 is, in principle, received via an unreliable channel, such that a frame loss occurs from time to time. It is also possible that a frame is received or detected too late, or that a bit error is detected. These occurrences have the effect of a frame loss: the frame is not available for decoding. In response to one of these failures, the decoder can behave in a concealment mode. The audio decoder 200 further provides, on the basis of the encoded audio information 210, the decoded audio information 212.

The audio decoder 200 may comprise a decoding/processing 220, which provides the decoded audio information 222 on the basis of the encoded audio information in the absence of a frame loss.

The audio decoder 200 further comprises an error concealment 230 (which can be embodied by the error concealment unit 100), which provides an error concealment audio information 232. The error concealment 230 is configured to provide the error concealment audio information 232 for concealing a loss of an audio frame.

In other words, the decoding/processing 220 may provide a decoded audio information 222 for audio frames which are encoded in the form of a frequency domain representation, i.e. in the form of an encoded representation, encoded values of which describe intensities in different frequency bins. Worded differently, the decoding/processing 220 may, for example, comprise a frequency domain audio decoder, which derives a set of spectral values from the encoded audio information 210 and performs a frequency-domain-to-time-domain transform to thereby derive a time domain representation which constitutes the decoded audio information 222 or which forms the basis for the provision of the decoded audio information 222 in case there is additional post processing.

Moreover, it should be noted that the audio decoder 200 can be supplemented by any of the features and functionalities described in the following, either individually or taken in combination.

5.3. Audio Decoder According to FIG. 3

Figure 3:
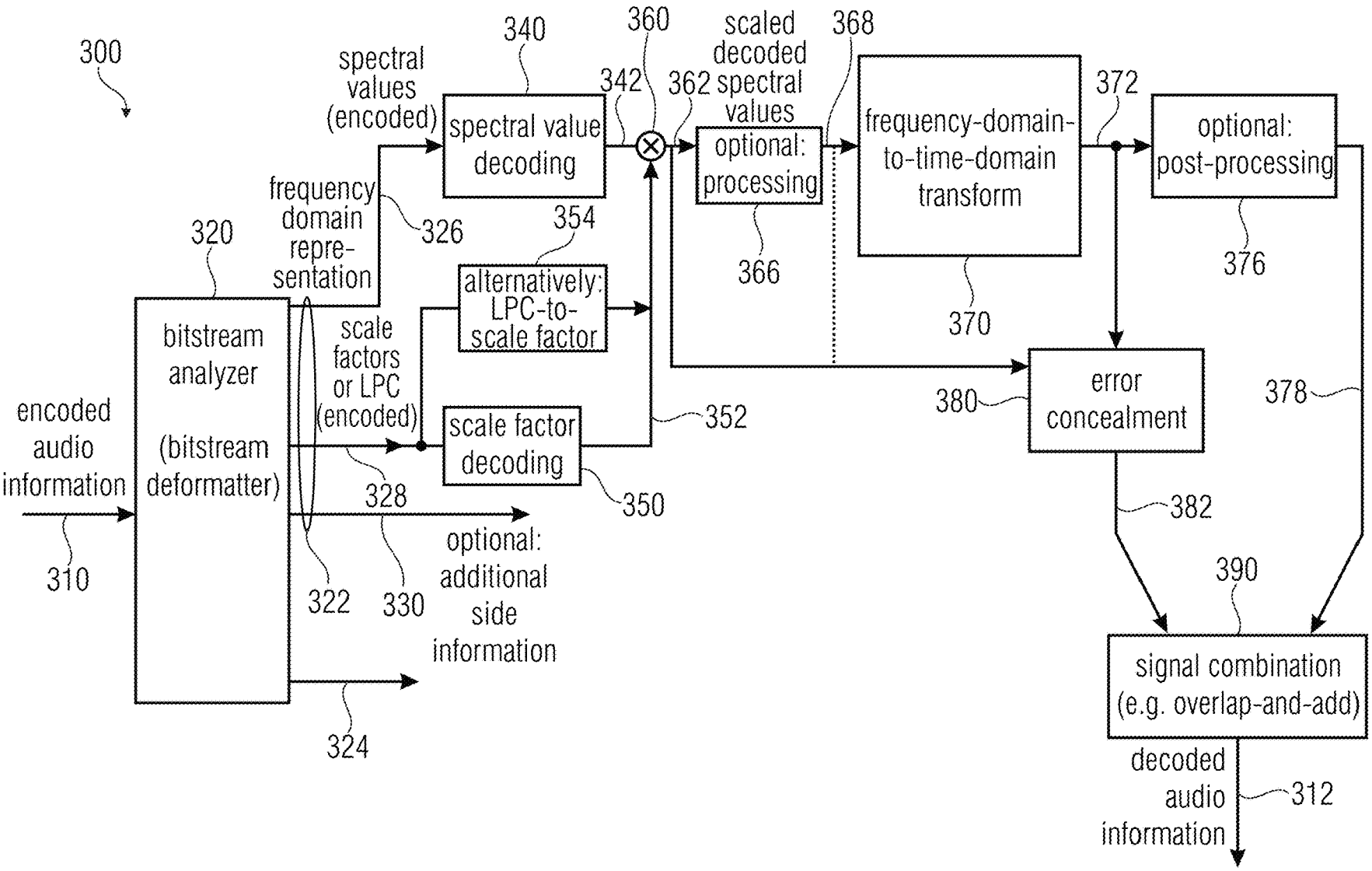
FIG. 3 shows a block schematic diagram of an audio decoder, according to another embodiment of the present invention.

FIG. 3 shows a block schematic diagram of an audio decoder 300, according to an embodiment of the invention.

The audio decoder 300 is configured to receive an encoded audio information 310 and to provide, on the basis thereof, a decoded audio information 312. The audio decoder 300 comprises a bitstream analyzer 320 (which may also be designated as a "bitstream deformatter" or "bitstream parser"). The bitstream analyzer 320 receives the encoded audio information 310 and provides, on the basis thereof, a frequency domain representation 322 and possibly additional control information 324. The frequency domain representation 322 may, for example, comprise encoded spectral values 326, encoded scale factors (or LPC representation) 328 and, optionally, an additional side information 330 which may, for example, control specific processing steps, like, for example, a noise filling, an intermediate processing or a post-processing. The audio decoder 300 also comprises a spectral value decoding 340 which is configured to receive the encoded spectral values 326, and to provide, on the basis thereof, a set of decoded spectral values 342. The audio decoder 300 may also comprise a scale factor decoding 350, which may be configured to receive the encoded scale factors 328 and to provide, on the basis thereof, a set of decoded scale factors 352.

Alternatively to the scale factor decoding, an LPC-to-scale factor conversion 354 may be used, for example, in the case that the encoded audio information comprises an encoded LPC information, rather than an scale factor information. However, in some coding modes (for example, in the TCX decoding mode of the USAC audio decoder or in the EVS audio decoder) a set of LPC coefficients may be used to derive a set of scale factors at the side of the audio decoder. This functionality may be reached by the LPC-to-scale factor conversion 354.

The audio decoder 300 may also comprise a scaler 360, which may be configured to apply the set of scaled factors 352 to the set of spectral values 342, to thereby obtain a set of scaled decoded spectral values 362. For example, a first frequency band comprising multiple decoded spectral values 342 may be scaled using a first scale factor, and a second frequency band comprising multiple decoded spectral values 342 may be scaled using a second scale factor. Accordingly, the set of scaled decoded spectral values 362 is obtained. The audio decoder 300 may further comprise an optional processing 366, which may apply some processing to the scaled decoded spectral values 362. For example, the optional processing 366 may comprise a noise filling or some other operations.

The audio decoder 300 may also comprise a frequency-domain-to-time-domain transform 370, which is configured to receive the scaled decoded spectral values 362, or a processed version 368 thereof, and to provide a time domain representation 372 associated with a set of scaled decoded spectral values 362. For example, the frequency-domain-to-time domain transform 370 may provide a time domain representation 372, which is associated with a frame or sub-frame of the audio content. For example, the frequency-domain-to-time-domain transform may receive a set of MDCT coefficients (which can be considered as scaled decoded spectral values) and provide, on the basis thereof, a block of time domain samples, which may form the time domain representation 372.

The audio decoder 300 may optionally comprise a post-processing 376, which may receive the time domain representation 372 and somewhat modify the time domain representation 372, to thereby obtain a post-processed version 378 of the time domain representation 372.

The audio decoder 300 also comprises an error concealment 380 which receives the time domain representation 372 from the frequency-domain-to-time-domain transform 370 and the scaled decoded spectral values 362 (or their processed version 368). Further, the error concealment 380 provides an error concealment audio information 382 for one or more lost audio frames. In other words, if an audio frame is lost, such that, for example, no encoded spectral values 326 are available for said audio frame (or audio sub-frame), the error concealment 380 may provide the error concealment audio information on the basis of the time domain representation 372 associated with one or more audio frames preceding the lost audio frame and the scaled decoded spectral values 362 (or their processed version 368). The error concealment audio information may typically be a time domain representation of an audio content.

It should be noted that the error concealment 380 may, for example, perform the functionality of the error concealment unit 100 and/or the error concealment 230 described above.

Regarding the error concealment, it should be noted that the error concealment does not happen at the same time of the frame decoding. For example if the frame n is good then we do a normal decoding, and at the end we save some variable that will help if we have to conceal the next frame, then if frame n+1 is lost we call the concealment function giving the variable coming from the previous good frame. We will also update some variables to help for the next frame loss or on the recovery to the next good frame.

The audio decoder 300 also comprises a signal combination 390, which is configured to receive the time domain representation 372 (or the post-processed time domain representation 378 in case that there is a post-processing 376). Moreover, the signal combination 390 may receive the error concealment audio information 382, which is typically also a time domain representation of an error concealment audio signal provided for a lost audio frame. The signal combination 390 may, for example, combine time domain representations associated with subsequent audio frames. In the case that there are subsequent properly decoded audio frames, the signal combination 390 may combine (for example, overlap-and-add) time domain representations associated with these subsequent properly decoded audio frames. However, if an audio frame is lost, the signal combination 390 may combine (for example, overlap-and-add) the time domain representation associated with the properly decoded audio frame preceding the lost audio frame and the error concealment audio information associated with the lost audio frame, to thereby have a smooth transition between the properly received audio frame and the lost audio frame. Similarly, the signal combination 390 may be configured to combine (for example, overlap-and-add) the error concealment audio information associated with the lost audio frame and the time domain representation associated with another properly decoded audio frame following the lost audio frame (or another error concealment audio information associated with another lost audio frame in case that multiple consecutive audio frames are lost).

Accordingly, the signal combination 390 may provide a decoded audio information 312, such that the time domain representation 372, or a post processed version 378 thereof, is provided for properly decoded audio frames, and such that the error concealment audio information 382 is provided for lost audio frames, wherein an overlap-and-add operation is typically performed between the audio information (irrespective of whether it is provided by the frequency-domain-to-time-domain transform 370 or by the error concealment 380) of subsequent audio frames.

Since some codecs have some aliasing on the overlap and add part that need to be cancelled, optionally we can create some artificial aliasing on the half a frame that we have created to perform the overlap add.

It should be noted that the functionality of the audio decoder 300 is similar to the functionality of the audio decoder 200 according to FIG. 2. Moreover, it should be noted that the audio decoder 300 according to FIG. 3 can be supplemented by any of the features and functionalities described herein. In particular, the error concealment 380 can be supplemented by any of the features and functionalities described herein with respect to the error concealment.

5.4. Audio Decoder 400 According to FIG. 4

FIG. 4 shows an audio decoder 400 according to another embodiment of the present invention.

The audio decoder 400 is configured to receive an encoded audio information and to provide, on the basis thereof, a decoded audio information 412. The audio decoder 400 may, for example, be configured to receive an encoded audio information 410, wherein different audio frames are encoded using different encoding modes. For example, the audio decoder 400 may be considered as a multi-mode audio decoder or a "switching" audio decoder. For example, some of the audio frames may be encoded using a frequency domain representation, wherein the encoded audio information comprises an encoded representation of spectral values (for example, FFT values or MDCT values) and scale factors representing a scaling of different frequency bands. Moreover, the encoded audio information 410 may also comprise a "time domain representation" of audio frames, or a "linear-prediction-coding domain representation" of multiple audio frames. The "linear-prediction-coding domain representation" (also briefly designated as "LPC representation") may, for example, comprise an encoded representation of an excitation signal, and an encoded representation of LPC parameters (linear-prediction-coding parameters), wherein the linear-prediction-coding parameters describe, for example, a linear-prediction-coding synthesis filter, which is used to reconstruct an audio signal on the basis of the time domain excitation signal.

In the following, some details of the audio decoder 400 will be described.

The audio decoder 400 comprises a bitstream analyzer 420 which may, for example, analyze the encoded audio information 410 and extract, from the encoded audio information 410, a frequency domain representation 422, comprising, for example, encoded spectral values, encoded scale factors and, optionally, an additional side information. The bitstream analyzer 420 may also be configured to extract a linear-prediction coding domain representation 424, which may, for example, comprise an encoded excitation 426 and encoded linear-prediction-coefficients 428 (which may also be considered as encoded linear-prediction parameters). Moreover, the bitstream analyzer may optionally extract additional side information, which may be used for controlling additional processing steps, from the encoded audio information.

The audio decoder 400 comprises a frequency domain decoding path 430, which may, for example, be substantially identical to the decoding path of the audio decoder 300 according to FIG. 3. In other words, the frequency domain decoding path 430 may comprise a spectral value decoding 340, a scale factor decoding 350, a scaler 360, an optional processing 366, a frequency-domain-to-time-domain transform 370, an optional post-processing 376 and an error concealment 380 as described above with reference to FIG. 3.

The audio decoder 400 may also comprise a linear-prediction-domain decoding path 440 (which may also be considered as a time domain decoding path, since the LPC synthesis is performed in the time domain). The linear-prediction-domain decoding path comprises an excitation decoding 450, which receives the encoded excitation 426 provided by the bitstream analyzer 420 and provides, on the basis thereof, a decoded excitation 452 (which may take the form of a decoded time domain excitation signal). For example, the excitation decoding 450 may receive an encoded transform-coded-excitation information, and may provide, on the basis thereof, a decoded time domain excitation signal. However, alternatively or in addition, the excitation decoding 450 may receive an encoded ACELP excitation, and may provide the decoded time domain excitation signal 452 on the basis of said encoded ACELP excitation information.

It should be noted that there are different options for the excitation decoding. Reference is made, for example, to the relevant Standards and publications defining the CELP coding concepts, the ACELP coding concepts, modifications of the CELP coding concepts and of the ACELP coding concepts and the TCX coding concept.

The linear-prediction-domain decoding path 440 optionally comprises a processing 454 in which a processed time domain excitation signal 456 is derived from the time domain excitation signal 452.

The linear-prediction-domain decoding path 440 also comprises a linear-prediction coefficient decoding 460, which is configured to receive encoded linear prediction coefficients and to provide, on the basis thereof, decoded linear prediction coefficients 462. The linear-prediction coefficient decoding 460 may use different representations of a linear prediction coefficient as an input information 428 and may provide different representations of the decoded linear prediction coefficients as the output information 462. For details, reference to made to different Standard documents in which an encoding and/or decoding of linear prediction coefficients is described.

The linear-prediction-domain decoding path 440 optionally comprises a processing 464, which may process the decoded linear prediction coefficients and provide a processed version 466 thereof.

The linear-prediction-domain decoding path 440 also comprises a LPC synthesis (linear-prediction coding synthesis) 470, which is configured to receive the decoded excitation 452, or the processed version 456 thereof, and the decoded linear prediction coefficients 462, or the processed version 466 thereof, and to provide a decoded time domain audio signal 472. For example, the LPC synthesis 470 may be configured to apply a filtering, which is defined by the decoded linear-prediction coefficients 462 (or the processed version 466 thereof) to the decoded time domain excitation signal 452, or the processed version thereof, such that the decoded time domain audio signal 472 is obtained by filtering (synthesis-filtering) the time domain excitation signal 452 (or 456). The linear prediction domain decoding path 440 may optionally comprise a post-processing 474, which may be used to refine or adjust characteristics of the decoded time domain audio signal 472.

The linear-prediction-domain decoding path 440 also comprises an error concealment 480, which is configured to receive the decoded linear prediction coefficients 462 (or the processed version 466 thereof) and the decoded time domain excitation signal 452 (or the processed version 456 thereof). The error concealment 480 may optionally receive additional information, like for example a pitch information. The error concealment 480 may consequently provide an error concealment audio information, which may be in the form of a time domain audio signal, in case that a frame (or sub-frame) of the encoded audio information 410 is lost. Thus, the error concealment 480 may provide the error concealment audio information 482 such that the characteristics of the error concealment audio information 482 are substantially adapted to the characteristics of a last properly decoded audio frame preceding the lost audio frame. It should be noted that the error concealment 480 may comprise any of the features and functionalities described with respect to the error concealment 100 and/or 230 and/or 380. In addition, it should be noted that the error concealment 480 may also comprise any of the features and functionalities described with respect to the time domain concealment of FIG. 6.

The audio decoder 400 also comprises a signal combiner (or signal combination 490), which is configured to receive the decoded time domain audio signal 372 (or the post-processed version 378 thereof), the error concealment audio information 382 provided by the error concealment 380, the decoded time domain audio signal 472 (or the post-processed version 476 thereof) and the error concealment audio information 482 provided by the error concealment 480. The signal combiner 490 may be configured to combine said signals 372 (or 378), 382, 472 (or 476) and 482 to thereby obtain the decoded audio information 412. In particular, an overlap-and-add operation may be applied by the signal combiner 490. Accordingly, the signal combiner 490 may provide smooth transitions between subsequent audio frames for which the time domain audio signal is provided by different entities (for example, by different decoding paths 430, 440). However, the signal combiner 490 may also provide for smooth transitions if the time domain audio signal is provided by the same entity (for example, frequency domain-to-time-domain transform 370 or LPC synthesis 470) for subsequent frames. Since some codecs have some aliasing on the overlap and add part that need to be cancelled, optionally we can create some artificial aliasing on the half a frame that we have created to perform the overlap add. In other words, an artificial time domain aliasing compensation (TDAC) may optionally be used.

Also, the signal combiner 490 may provide smooth transitions to and from frames for which an error concealment audio information (which is typically also a time domain audio signal) is provided.

To summarize, the audio decoder 400 allows to decode audio frames which are encoded in the frequency domain and audio frames which are encoded in the linear prediction domain. In particular, it is possible to switch between a usage of the frequency domain decoding path and a usage of the linear prediction domain decoding path in dependence on the signal characteristics (for example, using a signaling information provided by an audio encoder). Different types of error concealment may be used for providing an error concealment audio information in the case of a frame loss, depending on whether a last properly decoded audio frame was encoded in the frequency domain (or, equivalently, in a frequency-domain representation), or in the time domain (or equivalently, in a time domain representation, or, equivalently, in a linear-prediction domain, or, equivalently, in a linear-prediction domain representation).

5.5. Time Domain Concealment According to FIG. 5

FIG. 5 shows a block schematic diagram of an time domain error concealment according to an embodiment of the present invention. The error concealment according to FIG. 5 is designated in its entirety as 500 and can embody the time domain concealment 106 of FIG. 1. However, a downsampling which may be used at an input of the time domain concealment (for example, applied to signal 510), and an upsampling, which may be used at an output of the time domain concealment, and a low-pass filtering may also be applied, even though not shown in FIG. 5 for brevity.

The time domain error concealment 500 is configured to receive a time domain audio signal 510 (that can be a low frequency range of the signal 101) and to provide, on the basis thereof, an error concealment audio information component 512, which take the form of a time domain audio signal (e.g., signal 104) which can be used to provide the second error concealment audio information component.

The error concealment 500 comprises a pre-emphasis 520, which may be considered as optional. The pre-emphasis receives the time domain audio signal and provides, on the basis thereof, a pre-emphasized time domain audio signal 522.

The error concealment 500 also comprises a LPC analysis 530, which is configured to receive the time domain audio signal 510, or the pre-emphasized version 522 thereof, and to obtain an LPC information 532, which may comprise a set of LPC parameters 532. For example, the LPC information may comprise a set of LPC filter coefficients (or a representation thereof) and a time domain excitation signal (which is adapted for an excitation of an LPC synthesis filter configured in accordance with the LPC filter coefficients, to reconstruct, at least approximately, the input signal of the LPC analysis).

The error concealment 500 also comprises a pitch search 540, which is configured to obtain a pitch information 542, for example, on the basis of a previously decoded audio frame.

The error concealment 500 also comprises an extrapolation 550, which may be configured to obtain an extrapolated time domain excitation signal on the basis of the result of the LPC analysis (for example, on the basis of the time-domain excitation signal determined by the LPC analysis), and possibly on the basis of the result of the pitch search.

The error concealment 500 also comprises a noise generation 560, which provides a noise signal 562. The error concealment 500 also comprises a combiner/fader 570, which is configured to receive the extrapolated time-domain excitation signal 552 and the noise signal 562, and to provide, on the basis thereof, a combined time domain excitation signal 572. The combiner/fader 570 may be configured to combine the extrapolated time domain excitation signal 552 and the noise signal 562, wherein a fading may be performed, such that a relative contribution of the extrapolated time domain excitation signal 552 (which determines a deterministic component of the input signal of the LPC synthesis) decreases over time while a relative contribution of the noise signal 562 increases over time. However, a different functionality of the combiner/fader is also possible. Also, reference is made to the description below.

The error concealment 500 also comprises a LPC synthesis 580, which receives the combined time domain excitation signal 572 and which provides a time domain audio signal 582 on the basis thereof. For example, the LPC synthesis may also receive LPC filter coefficients describing a LPC shaping filter, which is applied to the combined time domain excitation signal 572, to derive the time domain audio signal 582. The LPC synthesis 580 may, for example, use LPC coefficients obtained on the basis of one or more previously decoded audio frames (for example, provided by the LPC analysis 530).

The error concealment 500 also comprises a de-emphasis 584, which may be considered as being optional. The de-emphasis 584 may provide a de-emphasized error concealment time domain audio signal 586.

The error concealment 500 also comprises, optionally, an overlap-and-add 590, which performs an overlap-and-add operation of time domain audio signals associated with subsequent frames (or sub-frames). However, it should be noted that the overlap-and-add 590 should be considered as optional, since the error concealment may also use a signal combination which is already provided in the audio decoder environment.

In the following, some further details regarding the error concealment 500 will be described.

The error concealment 500 according to FIG. 5 covers the context of a transform domain codec as AAC_LC or AAC_ELD. Worded differently, the error concealment 500 is well-adapted for usage in such a transform domain codec (and, in particular, in such a transform domain audio decoder). In the case of a transform codec only (for example, in the absence of a linear-prediction-domain decoding path), an output signal from a last frame is used as a starting point. For example, a time domain audio signal 372 may be used as a starting point for the error concealment. Advantageously, no excitation signal is available, just an output time domain signal from (one or more) previous frames (like, for example, the time domain audio signal 372).

In the following, the sub-units and functionalities of the error concealment 500 will be described in more detail.

5.5.1. LPC Analysis

In the embodiment according to FIG. 5, all of the concealment is done in the excitation domain to get a smoother transition between consecutive frames. Therefore, it is needed first to find (or, more generally, obtain) a proper set of LPC parameters. In the embodiment according to FIG. 5, an LPC analysis 530 is done on the past pre-emphasized time domain signal 522. The LPC parameters (or LPC filter coefficients) are used to perform LPC analysis of the past synthesis signal (for example, on the basis of the time domain audio signal 510, or on the basis of the pre-emphasized time domain audio signal 522) to get an excitation signal (for example, a time domain excitation signal).

5.5.2. Pitch Search

There are different approaches to get the pitch to be used for building the new signal (for example, the error concealment audio information).

In the context of the codec using an LTP filter (long-term-prediction filter), like AAC-LTP, if the last frame was AAC with LTP, we use this last received LTP pitch lag and the corresponding gain for generating the harmonic part. In this case, the gain is used to decide whether to build harmonic part in the signal or not. For example, if the LTP gain is higher than 0.6 (or any other predetermined value), then the LTP information is used to build the harmonic part.

If there is not any pitch information available from the previous frame, then there are, for example, two solutions, which will be described in the following.

For example, it is possible to do a pitch search at the encoder and transmit in the bitstream the pitch lag and the gain. This is similar to the LTP, but there is not applied any filtering (also no LTP filtering in the clean channel).

Alternatively, it is possible to perform a pitch search in the decoder. The AMR-WB pitch search in case of TCX is done in the FFT domain. In ELD, for example, if the MDCT domain was used then the phases would be missed. Therefore, the pitch search is done directly in the excitation domain. This gives better results than doing the pitch search in the synthesis domain. The pitch search in the excitation domain is done first with an open loop by a normalized cross correlation. Then, optionally, we refine the pitch search by doing a closed loop search around the open loop pitch with a certain delta. Due to the ELD windowing limitations, a wrong pitch could be found, thus we also verify that the found pitch is correct or discard it otherwise.

To conclude, the pitch of the last properly decoded audio frame preceding the lost audio frame may be considered when providing the error concealment audio information. In some cases, there is a pitch information available from the decoding of the previous frame (i.e. the last frame preceding the lost audio frame). In this case, this pitch can be reused (possibly with some extrapolation and a consideration of a pitch change over time). We can also optionally reuse the pitch of more than one frame of the past to try to extrapolate or predict the pitch that we need at the end of our concealed frame.

Also, if there is an information (for example, designated as long-term-prediction gain) available, which describes an intensity (or relative intensity) of a deterministic (for example, at least approximately periodic) signal component, this value can be used to decide whether a deterministic (or harmonic) component should be included into the error concealment audio information. In other words, by comparing said value (for example, LTP gain) with a predetermined threshold value, it can be decided whether a time domain excitation signal derived from a previously decoded audio frame should be considered for the provision of the error concealment audio information or not.

If there is no pitch information available from the previous frame (or, more precisely, from the decoding of the previous frame), there are different options. The pitch information could be transmitted from an audio encoder to an audio decoder, which would simplify the audio decoder but create a bitrate overhead. Alternatively, the pitch information can be determined in the audio decoder, for example, in the excitation domain, i.e. on the basis of a time domain excitation signal. For example, the time domain excitation signal derived from a previous, properly decoded audio frame can be evaluated to identify the pitch information to be used for the provision of the error concealment audio information.

5.5.3. Extrapolation of the Excitation or Creation of the Harmonic Part

The excitation (for example, the time domain excitation signal) obtained from the previous frame (either just computed for lost frame or saved already in the previous lost frame for multiple frame loss) is used to build the harmonic part (also designated as deterministic component or approximately periodic component) in the excitation (for example, in the input signal of the LPC synthesis) by copying the last pitch cycle as many times as needed to get one and a half of the frame. To save complexity we can also create one and an half frame only for the first loss frame and then shift the processing for subsequent frame loss by half a frame and create only one frame each. Then we have access to half a frame of overlap.

In case of the first lost frame after a good frame (i.e. a properly decoded frame), the first pitch cycle (for example, of the time domain excitation signal obtained on the basis of the last properly decoded audio frame preceding the lost audio frame) is low-pass filtered with a sampling rate dependent filter (since ELD covers a really broad sampling rate combination—going from AAC-ELD core to AAC-ELD with SBR or AAC-ELD dual rate SBR).

The pitch in a voice signal is changing almost at all times. Therefore, the concealment presented above tends to create some problems (or at least distortions) at the recovery because the pitch at end of the concealed signal (i.e. at the end of the error concealment audio information) often does not match the pitch of the first good frame. Therefore, optionally, in some embodiments it is tried to predict the pitch at the end of the concealed frame to match the pitch at the beginning of the recovery frame. For example, the pitch at the end of a lost frame (which is considered as a concealed frame) is predicted, wherein the target of the prediction is to set the pitch at the end of the lost frame (concealed frame) to approximate the pitch at the beginning of the first properly decoded frame following one or more lost frames (which first properly decoded frame is also called "recovery frame"). This could be done during the frame loss or during the first good frame (i.e. during the first properly received frame). To get even better results, it is possible to optionally reuse some conventional tools and adapt them, such as the Pitch Prediction and Pulse resynchronization. For details, reference is made, for example, to reference [4] and [5].

If a long-term-prediction (LTP) is used in a frequency domain codec, it is possible to use the lag as the starting information about the pitch. However, in some embodiments, it is also desired to have a better granularity to be able to better track the pitch contour. Therefore, it is advantageous to do a pitch search at the beginning and at the end of the last good (properly decoded) frame. To adapt the signal to the moving pitch, it is desirable to use a pulse resynchronization, which is present in the state of the art.

5.5.4. Gain of Pitch

In some embodiments, it is advantageous to apply a gain on the previously obtained excitation in order to reach the desired level. The "gain of the pitch" (for example, the gain of the deterministic component of the time domain excitation signal, i.e. the gain applied to a time domain excitation signal derived from a previously decoded audio frame, in order to obtain the input signal of the LPC synthesis), may, for example, be obtained by doing a normalized correlation in the time domain at the end of the last good (for example, properly decoded) frame. The length of the correlation may be equivalent to two sub-frames' length, or can be adaptively changed. The delay is equivalent to the pitch lag used for the creation of the harmonic part. We can also optionally perform the gain calculation only on the first lost frame and then only apply a fadeout (reduced gain) for the following consecutive frame loss.

The "gain of pitch" will determine the amount of tonality (or the amount of deterministic, at least approximately periodic signal components) that will be created. However, it is desirable to add some shaped noise to not have only an artificial tone. If we get very low gain of the pitch then we construct a signal that consists only of a shaped noise.

To conclude, in some cases the time domain excitation signal obtained, for example, on the basis of a previously decoded audio frame, is scaled in dependence on the gain (for example, to obtain the input signal for the LPC analysis). Accordingly, since the time domain excitation signal determines a deterministic (at least approximately periodic) signal component, the gain may determine a relative intensity of said deterministic (at least approximately periodic) signal components in the error concealment audio information. In addition, the error concealment audio information may be based on a noise, which is also shaped by the LPC synthesis, such that a total energy of the error concealment audio information is adapted, at least to some degree, to a properly decoded audio frame preceding the lost audio frame and, ideally, also to a properly decoded audio frame following the one or more lost audio frames.

5.5.5. Creation of the Noise Part

An "innovation" is created by a random noise generator. This noise is optionally further high pass filtered and optionally pre-emphasized for voiced and onset frames. As for the low pass of the harmonic part, this filter (for example, the high-pass filter) is sampling rate dependent. This noise (which is provided, for example, by a noise generation 560) will be shaped by the LPC (for example, by the LPC synthesis 580) to get as close to the background noise as possible. The high pass characteristic is also optionally changed over consecutive frame loss such that after a certain amount a frame loss there is no filtering anymore to only get the full band shaped noise to get a comfort noise close to the background noise.

An innovation gain (which may, for example, determine a gain of the noise 562 in the combination/fading 570, i.e. a gain using which the noise signal 562 is included into the input signal 572 of the LPC synthesis) is, for example, calculated by removing the previously computed contribution of the pitch (if it exists) (for example, a scaled version, scaled using the "gain of pitch", of the time domain excitation signal obtained on the basis of the last properly decoded audio frame preceding the lost audio frame) and doing a correlation at the end of the last good frame. As for the pitch gain, this could be done optionally only on the first lost frame and then fade out, but in this case the fade out could be either going to 0 that results to a completed muting or to an estimate noise level present in the background. The length of the correlation is, for example, equivalent to two sub-frames' length and the delay is equivalent to the pitch lag used for the creation of the harmonic part.

Optionally, this gain is also multiplied by (1-"gain of pitch") to apply as much gain on the noise to reach the energy missing if the gain of pitch is not one. Optionally, this gain is also multiplied by a factor of noise. This factor of noise is coming, for example, from the previous valid frame (for example, from the last properly decoded audio frame preceding the lost audio frame).

5.5.6. Fade Out

Fade out is mostly used for multiple frames loss. However, fade out may also be used in the case that only a single audio frame is lost.

In case of a multiple frame loss, the LPC parameters are not recalculated. Either, the last computed one is kept, or LPC concealment is done by converging to a background shape. In this case, the periodicity of the signal is converged to zero. For example, the time domain excitation signal 552 obtained on the basis of one or more audio frames preceding a lost audio frame is still using a gain which is gradually reduced over time while the noise signal 562 is kept constant or scaled with a gain which is gradually increasing over time, such that the relative weight of the time domain excitation signal 552 is reduced over time when compared to the relative weight of the noise signal 562. Consequently, the input signal 572 of the LPC synthesis 580 is getting more and more "noise-like". Consequently, the "periodicity" (or, more precisely, the deterministic, or at least approximately periodic component of the output signal 582 of the LPC synthesis 580) is reduced over time.

The speed of the convergence according to which the periodicity of the signal 572, and/or the periodicity of the signal 582, is converged to 0 is dependent on the parameters of the last correctly received (or properly decoded) frame and/or the number of consecutive erased frames, and is controlled by an attenuation factor, $\alpha$. The factor, $\alpha$, is further dependent on the stability of the LP filter. Optionally, it is possible to alter the factor $\alpha$ in ratio with the pitch length. If the pitch (for example, a period length associated with the pitch) is really long, then we keep $\alpha$ "normal", but if the pitch is really short, it is typically involved to copy a lot of times the same part of past excitation. This will quickly sound too artificial, and therefore it is advantageous to fade out faster this signal.

Further optionally, if available, we can take into account the pitch prediction output. If a pitch is predicted, it means that the pitch was already changing in the previous frame and then the more frames we lose the more far we are from the truth. Therefore, it is advantageous to speed up a bit the fade out of the tonal part in this case.

If the pitch prediction failed because the pitch is changing too much, it means that either the pitch values are not really reliable or that the signal is really unpredictable. Therefore, again, it is advantageous to fade out faster (for example, to fade out faster the time domain excitation signal 552 obtained on the basis of one or more properly decoded audio frames preceding the one or more lost audio frames).

5.5.7. LPC Synthesis

To come back to time domain, it is advantageous to perform a LPC synthesis 580 on the summation of the two excitations (tonal part and noisy part) followed by a de-emphasis. Worded differently, it is advantageous to perform the LPC synthesis 580 on the basis of a weighted combination of a time domain excitation signal 552 obtained on the basis of one or more properly decoded audio frames preceding the lost audio frame (tonal part) and the noise signal 562 (noisy part). As mentioned above, the time domain excitation signal 552 may be modified when compared to the time domain excitation signal 532 obtained by the LPC analysis 530 (in addition to LPC coefficients describing a characteristic of the LPC synthesis filter used for the LPC synthesis 580). For example, the time domain excitation signal 552 may be a time scaled copy of the time domain excitation signal 532 obtained by the LPC analysis 530, wherein the time scaling may be used to adapt the pitch of the time domain excitation signal 552 to a desired pitch.

5.5.8. Overlap-and-Add

In the case of a transform codec only, to get the best overlap-add we create an artificial signal for half a frame more than the concealed frame and we create artificial aliasing on it. However, different overlap-add concepts may be applied.

In the context of regular AAC or TCX, an overlap-and-add is applied between the extra half frame coming from concealment and the first part of the first good frame (could be half or less for lower delay windows as AAC-LD).

In the special case of ELD (extra low delay), for the first lost frame, it is advantageous to run the analysis three times to get the proper contribution from the last three windows and then for the first concealment frame and all the following ones the analysis is run one more time. Then one ELD synthesis is done to be back in time domain with all the proper memory for the following frame in the MDCT domain.

To conclude, the input signal 572 of the LPC synthesis 580 (and/or the time domain excitation signal 552) may be provided for a temporal duration which is longer than a duration of a lost audio frame. Accordingly, the output signal 582 of the LPC synthesis 580 may also be provided for a time period which is longer than a lost audio frame. Accordingly, an overlap-and-add can be performed between the error concealment audio information (which is consequently obtained for a longer time period than a temporal extension of the lost audio frame) and a decoded audio information provided for a properly decoded audio frame following one or more lost audio frames.

5.6 Time Domain Concealment According to FIG. 6

FIG. 6 shows a block schematic diagram of a time domain concealment which can be used for a switch codec. For example, the time domain concealment 600 according to FIG. 6 may, for example, take the place of the time domain error concealment 106, for example in the error concealment 380 of FIG. 3 or FIG. 4.

In the case of a switched codec (and even in the case of a codec merely performing the decoding in the linear-prediction-coefficient domain) we usually already have the excitation signal (for example, the time domain excitation signal) coming from a previous frame (for example, a properly decoded audio frame preceding a lost audio frame). Otherwise (for example, if the time domain excitation signal is not available), it is possible to do as explained in the embodiment according to FIG. 5, i.e. to perform an LPC analysis. If the previous frame was ACELP like, we also have already the pitch information of the sub-frames in the last frame. If the last frame was TCX (transform coded excitation) with LTP (long term prediction) we have also the lag information coming from the long term prediction. And if the last frame was in the frequency domain without long term prediction (LTP) then the pitch search is done directly in the excitation domain (for example, on the basis of a time domain excitation signal provided by an LPC analysis).

If the decoder is using already some LPC parameters in the time domain, we are reusing them and extrapolate a new set of LPC parameters. The extrapolation of the LPC parameters is based on the past LPC, for example the mean of the last three frames and (optionally) the LPC shape derived during the DTX noise estimation if DTX (discontinuous transmission) exists in the codec.

All of the concealment is done in the excitation domain to get smoother transition between consecutive frames.

In the following, the error concealment 600 according to FIG. 6 will be described in more detail.

The error concealment 600 receives a past excitation 610 and a past pitch information 640. Moreover, the error concealment 600 provides an error concealment audio information 612.

It should be noted that the past excitation 610 received by the error concealment 600 may, for example, correspond to the output 532 of the LPC analysis 530. Moreover, the past pitch information 640 may, for example, correspond to the output information 542 of the pitch search 540.

The error concealment 600 further comprises an extrapolation 650, which may correspond to the extrapolation 550, such that reference is made to the above discussion.

Moreover, the error concealment comprises a noise generator 660, which may correspond to the noise generator 560, such that reference is made to the above discussion.

The extrapolation 650 provides an extrapolated time domain excitation signal 652, which may correspond to the extrapolated time domain excitation signal 552. The noise generator 660 provides a noise signal 662, which corresponds to the noise signal 562.

The error concealment 600 also comprises a combiner/fader 670, which receives the extrapolated time domain excitation signal 652 and the noise signal 662 and provides, on the basis thereof, an input signal 672 for a LPC synthesis 680, wherein the LPC synthesis 680 may correspond to the LPC synthesis 580, such that the above explanations also apply. The LPC synthesis 680 provides a time domain audio signal 682, which may correspond to the time domain audio signal 582. The error concealment also comprises (optionally) a de-emphasis 684, which may correspond to the de-emphasis 584 and which provides a de-emphasized error concealment time domain audio signal 686. The error concealment 600 optionally comprises an overlap-and-add 690, which may correspond to the overlap-and-add 590. However, the above explanations with respect to the overlap-and-add 590 also apply to the overlap-and-add 690. In other words the overlap-and-add 690 may also be replaced by the audio decoder's overall overlap-and-add, such that the output signal 682 of the LPC synthesis or the output signal 686 of the de-emphasis may be considered as the error concealment audio information.

To conclude, the error concealment 600 substantially differs from the error concealment 500 in that the error concealment 600 directly obtains the past excitation information 610 and the past pitch information 640 directly from one or more previously decoded audio frames without the need to perform a LPC analysis and/or a pitch analysis. However, it should be noted that the error concealment 600 may, optionally, comprise a LPC analysis and/or a pitch analysis (pitch search).

In the following, some details of the error concealment 600 will be described in more detail. However, it should be noted that the specific details should be considered as examples, rather than as essential features.

5.6.1. Past Pitch of Pitch Search

There are different approaches to get the pitch to be used for building the new signal.

In the context of the codec using LTP filter, like AAC-LTP, if the last frame (preceding the lost frame) was AAC with LTP, we have the pitch information coming from the last LTP pitch lag and the corresponding gain. In this case we use the gain to decide if we want to build harmonic part in the signal or not. For example, if the LTP gain is higher than 0.6 then we use the LTP information to build harmonic part.

If we do not have any pitch information available from the previous frame, then there are, for example, two other solutions.

One solution is to do a pitch search at the encoder and transmit in the bitstream the pitch lag and the gain. This is similar to the long term prediction (LTP), but we are not applying any filtering (also no LTP filtering in the clean channel).

Another solution is to perform a pitch search in the decoder. The AMR-WB pitch search in case of TCX is done in the FFT domain. In TCX for example, we are using the MDCT domain, then we are missing the phases. Therefore, the pitch search is done directly in the excitation domain (for example, on the basis of the time domain excitation signal used as the input of the LPC synthesis, or used to derive the input for the LPC synthesis) in an embodiment. This typically gives better results than doing the pitch search in the synthesis domain (for example, on the basis of a fully decoded time domain audio signal).

The pitch search in the excitation domain (for example, on the basis of the time domain excitation signal) is done first with an open loop by a normalized cross correlation. Then, optionally, the pitch search can be refined by doing a closed loop search around the open loop pitch with a certain delta.

In implementations, we do not simply consider one maximum value of the correlation. If we have a pitch information from a non-error prone previous frame, then we select the pitch that corresponds to one of the five highest values in the normalized cross correlation domain but the closest to the previous frame pitch. Then, it is also verified that the maximum found is not a wrong maximum due to the window limitation.

To conclude, there are different concepts to determine the pitch, wherein it is computationally efficient to consider a past pitch (i.e. pitch associated with a previously decoded audio frame). Alternatively, the pitch information may be transmitted from an audio encoder to an audio decoder. As another alternative, a pitch search can be performed at the side of the audio decoder, wherein the pitch determination is performed on the basis of the time domain excitation signal (i.e. in the excitation domain). A two stage pitch search comprising an open loop search and a closed loop search can be performed in order to obtain a particularly reliable and precise pitch information. Alternatively, or in addition, a pitch information from a previously decoded audio frame may be used in order to ensure that the pitch search provides a reliable result.

5.6.2. Extrapolation of the Excitation or Creation of the Harmonic Part

The excitation (for example, in the form of a time domain excitation signal) obtained from the previous frame (either just computed for lost frame or saved already in the previous lost frame for multiple frame loss) is used to build the harmonic part in the excitation (for example, the extrapolated time domain excitation signal 662) by copying the last pitch cycle (for example, a portion of the time domain excitation signal 610, a temporal duration of which is equal to a period duration of the pitch) as many times as needed to get, for example, one and a half of the (lost) frame.

To get even better results, it is optionally possible to reuse some tools known from state of the art and adapt them. Reference can be made, for example, to reference [4] and/or reference [5].

It has been found that the pitch in a voice signal is changing almost at all times. It has been found that, therefore, the concealment presented above tends to create some problems at the recovery because the pitch at end of the concealed signal often doesn't match the pitch of the first good frame. Therefore, optionally, it is tried to predict the pitch at the end of the concealed frame to match the pitch at the beginning of the recovery frame. This functionality will be performed, for example, by the extrapolation 650.

If LTP in TCX is used, the lag can be used as the starting information about the pitch. However, it is desirable to have a better granularity to be able to track better the pitch contour. Therefore, a pitch search is optionally done at the beginning and at the end of the last good frame. To adapt the signal to the moving pitch, a pulse resynchronization, which is present in the state of the art, may be used.

To conclude, the extrapolation (for example, of the time domain excitation signal associated with, or obtained on the basis of, a last properly decoded audio frame preceding the lost frame) may comprise a copying of a time portion of said time domain excitation signal associated with a previous audio frame, wherein the copied time portion may be modified in dependence on a computation, or estimation, of an (expected) pitch change during the lost audio frame. Different concepts are available for determining the pitch change.

5.6.3. Gain of Pitch

In the embodiment according to FIG. 6, a gain is applied on the previously obtained excitation in order to reach a desired level. The gain of the pitch is obtained, for example, by doing a normalized correlation in the time domain at the end of the last good frame. For example, the length of the correlation may be equivalent to two sub-frames length and the delay may be equivalent to the pitch lag used for the creation of the harmonic part (for example, for copying the time domain excitation signal). It has been found that doing the gain calculation in time domain gives much more reliable gain than doing it in the excitation domain. The LPC are changing every frame and then applying a gain, calculated on the previous frame, on an excitation signal that will be processed by an other LPC set, will not give the expected energy in time domain.

The gain of the pitch determines the amount of tonality that will be created, but some shaped noise will also be added to not have only an artificial tone. If a very low gain of pitch is obtained, then a signal may be constructed that consists only of a shaped noise.

To conclude, a gain which is applied to scale the time domain excitation signal obtained on the basis of the previous frame (or a time domain excitation signal which is obtained for a previously decoded frame, or which is associated to the previously decoded frame) is adjusted to thereby determine a weighting of a tonal (or deterministic, or at least approximately periodic) component within the input signal of the LPC synthesis 680, and, consequently, within the error concealment audio information. Said gain can be determined on the basis of a correlation, which is applied to the time domain audio signal obtained by a decoding of the previously decoded frame (wherein said time domain audio signal may be obtained using a LPC synthesis which is performed in the course of the decoding).

5.6.4. Creation of the Noise Part

An innovation is created by a random noise generator 660. This noise is further high pass filtered and optionally pre-emphasized for voiced and onset frames. The high pass filtering and the pre-emphasis, which may be performed selectively for voiced and onset frames, are not shown explicitly in the FIG. 6, but may be performed, for example, within the noise generator 660 or within the combiner/fader 670.

The noise will be shaped (for example, after combination with the time domain excitation signal 652 obtained by the extrapolation 650) by the LPC to get as close as the background noise as possible.

For example, the innovation gain may be calculated by removing the previously computed contribution of the pitch (if it exists) and doing a correlation at the end of the last good frame. The length of the correlation may be equivalent to two sub-frames length and the delay may be equivalent to the pitch lag used for the creation of the harmonic part.

Optionally, this gain may also be multiplied by (1-gain of pitch) to apply as much gain on the noise to reach the energy missing if the gain of the pitch is not one. Optionally, this gain is also multiplied by a factor of noise. This factor of noise may be coming from a previous valid frame.

To conclude, a noise component of the error concealment audio information is obtained by shaping noise provided by the noise generator 660 using the LPC synthesis 680 (and, possibly, the de-emphasis 684). In addition, an additional high pass filtering and/or pre-emphasis may be applied. The gain of the noise contribution to the input signal 672 of the LPC synthesis 680 (also designated as "innovation gain") may be computed on the basis of the last properly decoded audio frame preceding the lost audio frame, wherein a deterministic (or at least approximately periodic) component may be removed from the audio frame preceding the lost audio frame, and wherein a correlation may then be performed to determine the intensity (or gain) of the noise component within the decoded time domain signal of the audio frame preceding the lost audio frame.

Optionally, some additional modifications may be applied to the gain of the noise component.

5.6.5. Fade Out

The fade out is mostly used for multiple frames loss. However, the fade out may also be used in the case that only a single audio frame is lost.

In case of multiple frame loss, the LPC parameters are not recalculated. Either the last computed one is kept or an LPC concealment is performed as explained above.

A periodicity of the signal is converged to zero. The speed of the convergence is dependent on the parameters of the last correctly received (or correctly decoded) frame and the number of consecutive erased (or lost) frames, and is controlled by an attenuation factor, $\alpha$. The factor, $\alpha$, is further dependent on the stability of the LP filter. Optionally, the factor $\alpha$ can be altered in ratio with the pitch length. For example, if the pitch is really long then a can be kept normal, but if the pitch is really short, it may be desirable (or needed) to copy a lot of times the same part of past excitation. Since it has been found that this will quickly sound too artificial, the signal is therefore faded out faster.

Furthermore optionally, it is possible to take into account the pitch prediction output. If a pitch is predicted, it means that the pitch was already changing in the previous frame and then the more frames are lost the more far we are from the truth. Therefore, it is desirable to speed up a bit the fade out of the tonal part in this case.

If the pitch prediction failed because the pitch is changing too much, this means either the pitch values are not really reliable or that the signal is really unpredictable. Therefore, again we should fade out faster.

To conclude, the contribution of the extrapolated time domain excitation signal 652 to the input signal 672 of the LPC synthesis 680 is typically reduced over time. This can be achieved, for example, by reducing a gain value, which is applied to the extrapolated time domain excitation signal 652, over time. The speed used to gradually reduce the gain applied to scale the time domain excitation signal 652 obtained on the basis of one or more audio frames preceding a lost audio frame (or one or more copies thereof) is adjusted in dependence on one or more parameters of the one or more audio frames (and/or in dependence on a number of consecutive lost audio frames). In particular, the pitch length and/or the rate at which the pitch changes over time, and/or the question whether a pitch prediction fails or succeeds, can be used to adjust said speed.

5.6.6. LPC Synthesis

To come back to time domain, an LPC synthesis 680 is performed on the summation (or generally, weighted combination) of the two excitations (tonal part 652 and noisy part 662) followed by the de-emphasis 684.

In other words, the result of the weighted (fading) combination of the extrapolated time domain excitation signal 652 and the noise signal 662 forms a combined time domain excitation signal and is input into the LPC synthesis 680, which may, for example, perform a synthesis filtering on the basis of said combined time domain excitation signal 672 in dependence on LPC coefficients describing the synthesis filter.

5.6.7. Overlap-and-Add

Since it is not known during concealment what will be the mode of the next frame coming (for example, ACELP, TCX or FD), it is advantageous to prepare different overlaps in advance. To get the best overlap-and-add if the next frame is in a transform domain (TCX or FD) an artificial signal (for example, an error concealment audio information) may, for example, be created for half a frame more than the concealed (lost) frame. Moreover, artificial aliasing may be created on it (wherein the artificial aliasing may, for example, be adapted to the MDCT overlap-and-add).

To get a good overlap-and-add and no discontinuity with the future frame in time domain (ACELP), we do as above but without aliasing, to be able to apply long overlap add windows or if we want to use a square window, the zero input response (ZIR) is computed at the end of the synthesis buffer.

To conclude, in a switching audio decoder (which may, for example, switch between an ACELP decoding, a TCX decoding and a frequency domain decoding (FD decoding)), an overlap-and-add may be performed between the error concealment audio information which is provided primarily for a lost audio frame, but also for a certain time portion following the lost audio frame, and the decoded audio information provided for the first properly decoded audio frame following a sequence of one or more lost audio frames. In order to obtain a proper overlap-and-add even for decoding modes which bring along a time domain aliasing at a transition between subsequent audio frames, an aliasing cancelation information (for example, designated as artificial aliasing) may be provided. Accordingly, an overlap-and-add between the error concealment audio information and the time domain audio information obtained on the basis of the first properly decoded audio frame following a lost audio frame, results in a cancellation of aliasing.

If the first properly decoded audio frame following the sequence of one or more lost audio frames is encoded in the ACELP mode, a specific overlap information may be computed, which may be based on a zero input response (ZIR) of a LPC filter.

To conclude, the error concealment 600 is well suited to usage in a switching audio codec. However, the error concealment 600 can also be used in an audio codec which merely decodes an audio content encoded in a TCX mode or in an ACELP mode.

5.6.8 Conclusion

It should be noted that a particularly good error concealment is achieved by the above mentioned concept to extrapolate a time domain excitation signal, to combine the result of the extrapolation with a noise signal using a fading (for example, a cross-fading) and to perform an LPC synthesis on the basis of a result of a cross-fading.

5.7 Frequency Domain Concealment According to FIG. 7

A frequency domain concealment is depicted in FIG. 7. At step 701 it is determined (e.g., based on CRC or a similar strategy) if the current audio information contains a properly decoded frame. If the outcome of the determination is positive, a spectral value of the properly decoded frame is used as proper audio information at 702. The spectrum is recorded in a buffer 703 for further use (e.g., for future incorrectly decoded frames to be therefore concealed).

If the outcome of the determination is negative, at step 704 a previously recorded spectral representation 705 of the previous properly decoded audio frame (saved in a buffer at step 703 in a previous cycle) is used to substitute the corrupted (and discarded) audio frame.

In particular, a copier and scaler 707 copies and scales spectral values of the frequency bins (or spectral bins) in the frequency ranges 705*a*, 705*b*, . . . , of the previously recorded properly spectral representation 705 of the previous properly decoded audio frame, to obtain values of the frequency bins (or spectral bins) 706*a*, 706*b*, . . . , to be used instead of the corrupted audio frame.

Each of the spectral values can be multiplied by a respective coefficient according to the specific information carried by the band. Further, damping factors 708 between 0 and 1 can be used to dampen the signal to iteratively reduce the strength of the signal in case of consecutive concealments. Also, noise can optionally be added in the spectral values 706.

5.8.a) Concealment According to FIG. 8*a*

FIG. 8*a* shows a block schematic diagram of an error concealment according to an embodiment of the present invention. The error concealment unit according to FIG. 8*a* is designated in its entirety as 800 and can embody any of the error concealment units 100, 230, 380 discussed above. The error concealment unit 800 provides an error concealment audio information 802 (which can embody the information 102, 232, or 382 of the embodiments discussed above) for concealing a loss of an audio frame in an encoded audio information.

The error concealment unit 800 can be input by a spectrum 803 (e.g., the spectrum of the last properly decoded audio frame spectrum, or, more in general, the spectrum of a previous properly decoded audio frame spectrum, or a filtered version thereof) and a time domain representation 804 of a frame (e.g., a last or a previous properly decoded time domain representation of an audio frame, or a last or a previous pcm buffered value).

The error concealment unit 800 comprises a first part or path (input by the spectrum 803 of the properly decoded audio frame), which may operate at (or in) a first frequency range, and a second part or path (input by the time domain representation 804 of the properly decoded audio frame), which may operate at (or in) a second frequency range. The first frequency range may comprise higher frequencies than the frequencies of the second frequency range.

Figure 14:
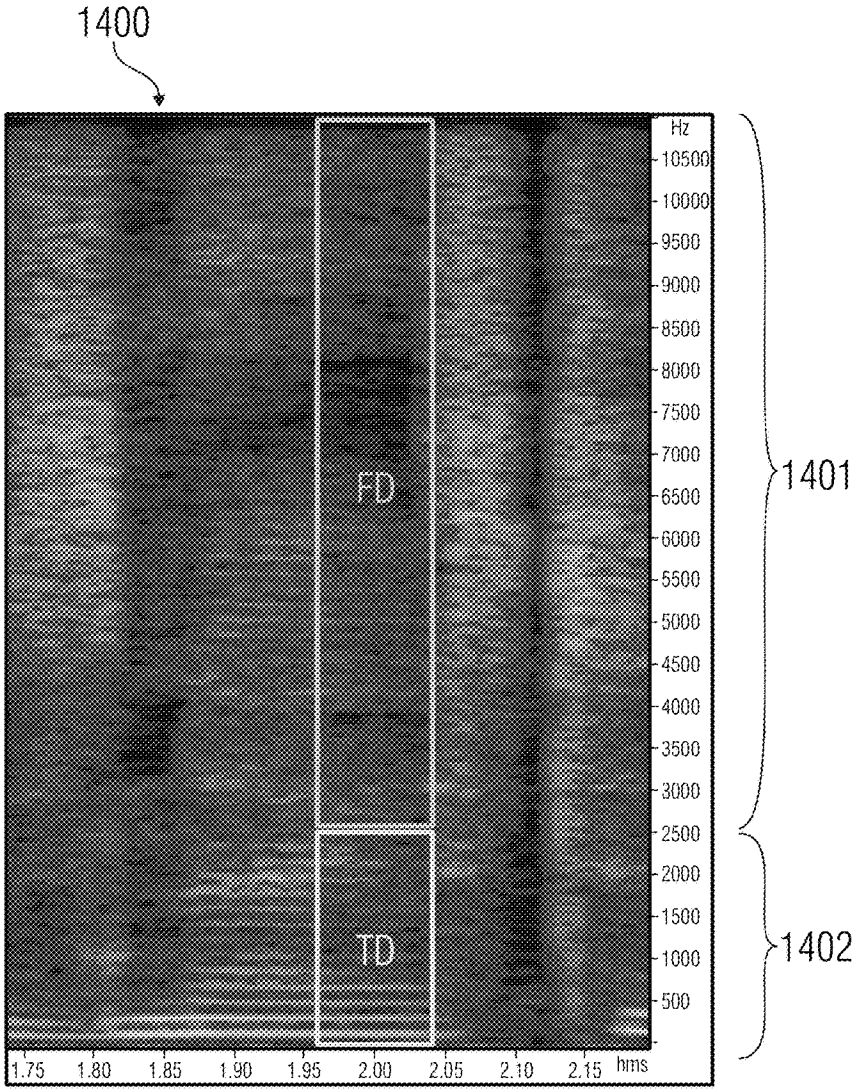

FIG. 14 shows an example of first frequency range 1401 and an example of second frequency range 1402.

A frequency domain concealment 805 can be applied to the first part or path (to the first frequency range). For example, noise substitution inside an AAC-ELD audio codec can be used. This mechanism uses a copied spectrum of the last good frame and adds noise before an inverse modified discrete cosine transform (IMDCT) is applied to get back to time domain. The concealed spectrum can be transformed to time domain via IMDCT.

The error concealment audio information 802 provided by the error concealment unit 800 is obtained as a combination of a first error concealment audio information component 807' provided by the first part and a second error concealment audio information component 811' provided by the second part. In some embodiments, the first component 807' can be intended as representing a high frequency portion of a lost audio frame, while the second component 811' can be intended as representing a low frequency portion of the lost audio frame.

The first part of the error concealment unit 800 can be used to derive the first component 807' using a transform domain representation of a high frequency portion of a properly decoded audio frame preceding a lost audio frame. The second part of the error concealment unit 800 can be used to derive the second component 811' using a time domain signal synthesis on the basis of a low frequency portion of the properly decoded audio frame preceding the lost audio frame.

Advantageously, the first part and the second part of the error concealment unit 800 operate in parallel (and/or simultaneously or quasi-simultaneously) to each other.

In the first part, a frequency domain error concealment 805 provides a first error concealment audio information 805' (spectral domain representation).

An inverse modified discrete cosine transform (IMDCT) 806 may be used to provide a time domain representation 806' of the spectral domain representation 805' obtained by the frequency domain error concealment 805, in order to obtain a time domain representation 806' on the basis of the first error concealment audio information.

As will be explained below, it is possible to perform the IMDCT twice to get two consecutive frames in the time domain.

In the first part or path, a high pass filter 807 may be used to filter the time domain representation 806' of the first error concealment audio information 805' and to provide a high frequency filtered version 807'. In particular, the high pass filter 807 may be positioned downstream of the frequency domain concealment 805 (e.g., before or after the IMDCT 805). In other embodiments, the high pass filter 807 (or an additional high-pass filter, which may "cut-off" some low-frequency spectral bins) may be positioned before the frequency domain concealment 805.

The high pass filter 807 may be tuned, for example, to a cutoff frequency between 6 KHz and 10 KHz, advantageously 7 KHz and 9 KHz, more advantageously between 7.5 KHz and 8.5 KHz, even more advantageously between 7.9 KHz and 8.1 KHz, and even more advantageously 8 KHz.

According to some embodiments, it is possible to signal-adaptively adjust a lower frequency boundary of the high-pass filter 807, to thereby vary a bandwidth of the first frequency range.

In the second part (which is configured to operate, at least partially, at lower frequencies than the frequencies of the first frequency range) of the error concealment unit 800, a time domain error concealment 809 provides a second error concealment audio information 809'.

In the second part, upstream of the time domain error concealment 809, a down-sample 808 provides a down-sampled version 808' of a time-domain representation 804 of the properly decoded audio frame. The down-sample 808 permits to obtain a down-sampled time-domain representation 808' of the audio frame 804 preceding the lost audio frame. This down-sampled time-domain representation 808' represents a low frequency portion of the audio frame 804.

In the second part, downstream of the time domain error concealment 809, an upsampler 810 provides an upsampled version 810' of the second error concealment audio information 809'. Accordingly, it is possible to up-sample the concealed audio information 809' provided by the time domain concealment 809, or a post-processed version thereof, in order to obtain the second error concealment audio information component 811'.

The time domain concealment 809 is, therefore, performed using a sampling frequency which is smaller than a sampling frequency involved to fully represent the properly decoded audio frame 804.

According to an embodiment, it is possible to signal-adaptively adjust a sampling rate of the down-sampled time-domain representation 808', to thereby vary a bandwidth of the second frequency range.

A low-pass filter 811 may be provided to filter an output signal 809' of the time domain concealment (or the output signal 810' of the upsample 810), in order to obtain the second error concealment audio information component 811'.

According to the invention, the first error concealment audio information component (as output by the high pass filter 807, or in other embodiments by the IMDCT 806 or the frequency domain concealment 805) and the second error concealment audio information component (as output by the low pass filter 811 or in other embodiments by the upsample 810 or the time domain concealment 809) can be composed (or combined) with each other using an overlap-and-add (OLA) mechanism 812.

Accordingly, the error concealment audio information 802 (which can embody the information 102, 232, or 382 of the embodiments discussed above) is obtained.

5.8.b) Concealment According to FIG. 8*b*

FIG. 8*b* shows a variant 800*b* for the error concealment unit 800 (all the features of the embodiment of FIG. 8*a* can apply to the present variant, and, therefore, their properties are not repeated). A control (e.g., a controller) 813 is provided to determine and/or signal-adaptively vary the first and/or second frequency ranges.

The control 813 can be based on characteristics chosen between characteristics of one or more encoded audio frames and characteristics of one or more properly decoded audio frames, such as the last spectrum 803 and the last pcm buffered value 804. The control 813 can also be based on aggregated data (integral values, average values, statistical values, etc.) of these inputs.

In some embodiments, a selection 814 (e.g., obtained by appropriated input means such as a keyboard, a graphical user interface, a mouse, a lever) can be provided. The selection can be input by a user or by a computer program running in a processor.

The control 813 can control (where provided) the down-sampler 808, and/or the upsample 810, and/or the low pass filter 811, and/or the high pass filter 807. In some embodiments, the control 813 controls a cutoff frequency between the first frequency range and the second frequency range.

In some embodiments, the control 813 can obtain information about a harmonicity of one or more properly decoded audio frames and perform the control of the frequency ranges on the basis of the information on the harmonicity. In alternative or in addition, the control 813 can obtain information about a spectral tilt of one or more properly decoded audio frames and perform the control on the basis of the information about the spectral tilt.

In some embodiments, the control 813 can choose the first frequency range and the second frequency range such that the harmonicity is comparatively smaller in the first frequency range when compared to the harmonicity in the second frequency range.

It is possible to embody the invention such that the control 813 determines up to which frequency the properly decoded audio frame preceding the lost audio frame comprises a harmonicity which is stronger than a harmonicity threshold, and choose the first frequency range and the second frequency range in dependence thereon.

According to some implementations, the control 813 can determine or estimate a frequency border at which a spectral tilt of the properly decoded audio frame preceding the lost audio frame changes from a smaller spectral tilt to a larger spectral tilt, and choose the first frequency range and the second frequency range in dependence thereon.

In some embodiments, the control 813 determines or estimates whether a variation of a spectral tilt of the properly decoded audio frame preceding the lost audio frame is smaller than a predetermined spectral tilt threshold over a given frequency range. The error concealment audio information 802 is obtained using the time-domain concealment 809 only if it is found that the variation of a spectral tilt of the properly decoded audio frame preceding the lost audio frame is smaller than the predetermined spectral tilt threshold.

According to some embodiments, the control 813 can adjust the first frequency range and the second frequency range, such that the first frequency range covers a spectral region which comprises a noise-like spectral structure, and such that the second frequency range covers a spectral region which comprises a harmonic spectral structure.

In some implementations, the control 813 can adapt a lower frequency end of the first frequency range and/or a higher frequency end of the second frequency range in dependence on an energy relationship between harmonics and noise.

According to some aspects of the invention, the control 813 selectively inhibits at least one of the time domain concealment 809 and frequency domain concealment 805 and/or performs time domain concealment 809 only or frequency domain concealment 805 only to obtain the error concealment audio information.

In some embodiments, the control 813 determines or estimates whether a harmonicity of the properly decoded audio frame preceding the lost audio frame is smaller than a predetermined harmonicity threshold. The error concealment audio information can be obtained using the frequency-domain concealment 805 only if it is found that the harmonicity of the properly decoded audio frame preceding the lost audio frame is smaller than the predetermined harmonicity threshold.

In some embodiments, the control 813 adapts a pitch of a concealed frame based on a pitch of a properly decoded audio frame preceding a lost audio frame and/or in dependence of a temporal evolution of the pitch in the properly decoded audio frame preceding the lost audio frame, and/or in dependence on an interpolation of the pitch between the properly decoded audio frame preceding the lost audio frame and a properly decoded audio frame following the lost audio frame.

In some embodiments, the control 813 receives data (e.g., the crossover frequency or a data related thereto) that are transmitted by the encoder. Accordingly, the control 813 can modify the parameters of other blocks (e.g., blocks 807, 808, 810, 811) to adapt the first and second frequency range to a value transmitted by the encoder.

5.9. Method According to FIG. 9

FIG. 9 shows a flow chart 900 of an error concealment method for providing an error concealment audio information (e.g., indicated with 102, 232, 382, and 802 in the previous examples) for concealing a loss of an audio frame in an encoded audio information. The method comprises:

at 910, providing a first error concealment audio information component (e.g., 103 or 807') for a first frequency range using a frequency domain concealment (e.g., 105 or 805), at 920 (which can be simultaneous or almost simultaneous to step 910, and can be intended to be parallel to step 910), providing a second error concealment audio information component (e.g., 104 or 811') for a second frequency range, which comprises (at least some) lower frequencies than the first frequency range, using a time domain concealment (e.g., 106, 500, 600, or 809), and at 930, combining (e.g., 107 or 812) the first error concealment audio information component and the second error concealment audio information component, to obtain the error concealment audio information (e.g., 102, 232, 382, or 802).

5.10. Method According to FIG. 10

FIG. 10 shows a flow chart 1000 which is a variant of FIG. 9 in which the control 813 of FIG. 8*b* or a similar control is used to determine and/or signal-adaptively vary the first and/or second frequency ranges. With respect to the method of FIG. 9, this variant comprises a step 905 in which the first and second frequency ranges are determined, e.g., on the basis of a user selection 814 or of the comparison of a value (e.g., a tilt value or a harmonicity value) with a threshold value.

Notably, step 905 can be performed by keeping in account the operation modes of control 813 (which can be some of those discussed above). For example, it is possible that data (e.g., a crossover frequency) are transmitted from the encoder in a particular data field. At steps 910 and 920, the first and second frequency ranges are controlled (at least partially) by the encoder.

5.11. Encoder According to FIG. 19

FIG. 19 shows an audio encoder 1900 which can be used to embody the invention according to some embodiments.

The audio encoder 1900 provides an encoded audio information 1904 on the basis of an input audio information 1902. Notably, the encoded audio representation 1904 can contain the encoded audio information 210, 310, 410.

In one embodiment, the audio encoder 1900 can comprise a frequency domain encoder 1906 configured to provide an encoded frequency domain representation 1908 on the basis of the input audio information 1902. The encoded frequency domain representation 1908 can comprise spectral values 1910 and scale factors 1912, which may correspond to the information 422. The encoded frequency domain representation 1908 can embody the (or a part of the) encoded audio information 210, 310, 410.

In one embodiment, the audio encoder 1900 can comprise (as an alternative to the frequency-domain encoder or as a replacement of the frequency domain encoder) a linear-prediction-domain encoder 1920 configured to provide an encoded linear-prediction-domain representation 1922 on the basis of the input audio information 1902. The encoded linear-prediction-domain representation 1922 can contain an excitation 1924 and a linear prediction 1926, which may correspond to the encoded excitation 426 and the encoded linear prediction coefficient 428. The encoded linear-prediction-domain representation 1922 can embody the (or a part of the) encoded audio information 210, 310, 410.

The audio encoder 1900 can comprise a crossover frequency determinator 1930 configured to determine a crossover frequency information 1932. The crossover frequency information 1932 can define a crossover frequency. The crossover frequency can be used to discriminate between a time domain error concealment (e.g., 106, 809, 920) and a frequency domain error concealment (e.g., 105, 805, 910) to be used at the side of an audio decoder (e.g., 100, 200, 300, 400, 800*b*).

The audio encoder 1900 can be configured to include (e.g., by using a bitstream combiner 1940) the encoded frequency domain representation 1908 and/or the encoded linear-prediction-domain representation 1922 and also the crossover frequency information 1932 into the encoded audio representation 1904.

The crossover frequency information 1932, when evaluated at the side of an audio decoder, can have the role of providing commands and/or instructions to the control 813 of an error concealment unit such as the error concealment unit 800*b*.

Without repeating the features of the control 813, it can be simply stated that the crossover frequency information 1932 can have the same functions discussed for the control 813. In other words, the crossover frequency information may be used to determine the crossover frequency, i.e. the frequency boundary between linear-prediction-domain concealment and frequency-domain concealment. Thus when receiving and using the crossover frequency information, the control 813 may be strongly simplified, since the control will no longer be responsible for determining the crossover frequency in this case. Rather, the control may only need to adjust the filters 807,811 in dependence on the crossover frequency information extracted from the encoded audio representation by the audio decoder.

The control can be, in some embodiments, understood as subdivided into two different (remote) units: an encodersided crossover frequency determinator which determines the crossover frequency information 1932 which in turn determinates the crossover frequency, and a decoder-sided controller 813, which receives the crossover frequency information and operates by appropriately setting the components of the decoder error concealment unit 800*b* on the basis thereof. For example the controller 813 can control (where provided) the downsampler 808, and/or the upsampler 810, and/or the low pass filter 811, and/or the high pass filter 807.

Hence, in one embodiment a system is formed with:

an audio encoder 1900 which can transmit an encoded audio information which comprises information 1932 associated to a first frequency range and a second frequency range (for example, a crossover-frequency information as described herein);

an audio decoder comprising:

an error concealment unit 800*b* configured to provide:

a first error concealment audio information component 807' for a first frequency range using a frequency domain concealment; and a second error concealment audio information component 811' for a second frequency range, which comprises lower frequencies than the first frequency range, using a time domain concealment 809, wherein the error concealment unit is configured to perform the control (813) on the basis of the information 1932 transmitted by the encoder 1900 wherein the error concealment unit 800*b* is further configured to combine the first error concealment audio information component 807' and the second error concealment audio information component 811', to obtain the error concealment audio information 802.

According to an embodiment (which can be, for example performed using the encoder 1900 and/or the concealment unit 800*b*), the invention provides a method 2000 (FIG. 20) for providing an encoded audio representation (e.g., 1904) on the basis of an input audio information (e.g., 1902), the method comprising:

a frequency domain encoding step 2002 (e.g., performed by block 1906) to provide an encoded frequency domain representation (e.g., 1908) on the basis of the input audio information, and/or a linear-prediction-domain encoding step (e.g., performed by block 1920) to provide an encoded linear-prediction-domain representation (e.g., 1922) on the basis of the input audio information; and a crossover frequency determining step 2004 (e.g., performed by block 1930) to determine a crossover frequency information (e.g., 1932) which defines a crossover frequency between a time domain error concealment (e.g., performed by block 809) and a frequency domain error concealment (e.g., performed by block 805) to be used at the side of an audio decoder;

wherein encoding step is configured to include the encoded frequency domain representation and/or the encoded linear-prediction-domain representation and also the crossover frequency information into the encoded audio representation.

Further, the encoded audio representation can (optionally) be provided and/or transmitted (step 2006) together with the crossover frequency information included therein to a receiver (decoder), which can decode the information and, in case of frame loss, perform a concealment. For example, a concealment unit (e.g., 800*b*) of the decoder can perform steps 910-930 of method 1000 of FIG. 10, while the step 905 of method 1000 is embodied by step 2004 of method 2000 (or wherein the functionality of step 905 is performed at the side of the audio encoder, and wherein step 905 is replaced by evaluation the crossover frequency information included in the encoded audio representation).

The invention also regards an encoded audio representation (e.g., 1904), comprising:

an encoded frequency domain representation (e.g., 1908) representing an audio content, and/or an encoded linear-prediction-domain representation (e.g., 1922) representing an audio content; and a crossover frequency information (e.g., 1932) which defines a crossover frequency between a time domain error concealment and a frequency domain error concealment to be used at the side of an audio decoder.

5.12 Fade Out

In addition to the disclosure above, the error concealment unit can fade a concealed frame. With reference to FIGS. 1, 8*a*, and 8*b*, a fade out can be operated at the FD concealment 105 or 805 (e.g., by scaling values of the frequency bins in the frequency ranges 705*a*, 705*b* by the damping factors 708 of FIG. 7) to damp the first error concealment component 105 or 807'. A fade out can be also operated at the TD concealment 809 by scaling values by appropriate damping factors to damp the second error concealment component 104 or 811' (see combiner/fader 570 or section 5.5.6 above).

In addition or in alternative, it is also possible to scale the error concealment audio information 102 or 802.

6. OPERATION OF THE INVENTION

An example of operation of the invention is here provided. In an audio decoder (e.g., the audio decoder 200, 300, or 400) some data frame may be lost. Accordingly, the error concealment unit (e.g., 100, 230, 380, 800, 800*b*) is used to conceal lost data frames using, for each lost data frame, a previous properly decoded audio frame.

The error concealment unit (e.g., 100, 230, 380, 800, 800*b*) operates as follows:

in a first part or path (e.g., for obtaining a first error concealment audio information component 807' at a first frequency range), a frequency-domain high-frequency error concealment of the lost signal is performed using a frequency spectrum representation (e.g., 803) of a previous properly decoded audio frame;

in parallel and/or simultaneously (or substantially simultaneously), in a second part or path (for obtaining a second error concealment audio information component at a second frequency range) a time-domain concealment is performed to a time-domain representation (e.g. 804) of a previous properly decoded audio frame (e.g., a pcm buffered value).

It can be hypothesized that (e.g., for the high pass filter 807 and the low pass filter 811) a cutoff frequency $FS_{out}/4$ is defined (e.g., predefined, preselected, or controlled, e.g. in a feedback-like fashion, by a controller such as the controller 813), so that most of the frequencies of the first frequency range are over $FS_{out}/4$ and most of the frequencies of the second frequency range are below $FS_{out}/4$ (core sampling rate). $FS_{out}$ can be set at a value that can be, for example between 46 KHz and 50 KHz, advantageously between 47 KHz and 49 KHz, and more advantageously 48 KHz.

$FS_{out}$ is normally (but not necessarily) higher (for example 48 kHz) than 16 kHz (the core sampling rate).

In the second (low frequency) part of an error concealment unit (e.g., 100, 230, 380, 800, 800*b*), the following operations can be carried out:

- at a downsample 808, a time domain representation 804 of the properly decoded audio frame is downsampled to the desired core sampling rate (here 16 kHz);
- a time domain concealment is performed at 809 to provide a synthesized signal 809';
- at the upsample 810, the synthesized signal 809' is upsampled to provide signal 810' at the output sampling rate ($FS_{out}$);
- finally, the signal 810' is filtered with a low pass filter 811, advantageously with a cut-off frequency (here 8 kHz) which is half of the core sampling rate (for example, 16 KHz).

In the first (high frequency) part of an error concealment unit, the following operations can be carried out:

- a frequency domain concealment 805 conceals a high frequency part of an input spectrum (of the properly decoded frame);
- the spectrum 805' output by the frequency domain concealment 805 is transformed to time domain (e.g., via IMDCT 806) as a synthesized signal 806';
- the synthesized signal 806' is filtered with a high pass filter 807, with a cut-off frequency (8 KHz) of half of the core sampling rate (16 KHz).

To combine the higher frequency component (e.g., 103 or 807') with the lower frequency component (e.g., 104 or 811'), an overlap and add (OLA) mechanism (e.g., 812) is used in the time domain. For AAC like codec, more than one frame (typically one and a half frames) have to be updated for one concealed frame. This is because the analysis and synthesis method of the OLA has a half frame delay. An additional half frame is needed. Thus, the IMDCT 806 is called twice to get two consecutive frames in the time domain. Reference can be made to graphic 1100 of FIG. 11, which shows the relationship between concealed frames 1101 and lost frames 1102. Finally, the low frequency and high frequency part are summed up and the OLA mechanism is applied.

In particular using the equipment shown in FIG. 8*b* or implementing the method of FIG. 10, it is possible to perform a selection of the first and second frequency ranges or adapt dynamically the cross-over frequency between time domain (TD) and frequency domain (FD) concealment, for example on the basis of the harmonicity and/or tilt of the previous properly decoded audio frame or frames.

For example, in case of a female speech item with background noise, the signal can be down sampled to 5 khz and the time domain concealment will do a good concealment for the most important part of the signal. The noisy part will then be synthesized with the frequency domain concealment method. This will reduce the complexity compared to a fixed cross over (or fixed down sample factor) and remove annoying "beep"-artefacts (see plots discussed below).

If the pitch is known for every frame, it is possible to make use of one key advantage of time domain concealment compared to any frequency domain tonal concealment: it is possible to vary the pitch inside the concealed frame, based on the past pitch value (if delay requirements permit, it is also possible to use future frame for interpolation).

Figure 12:
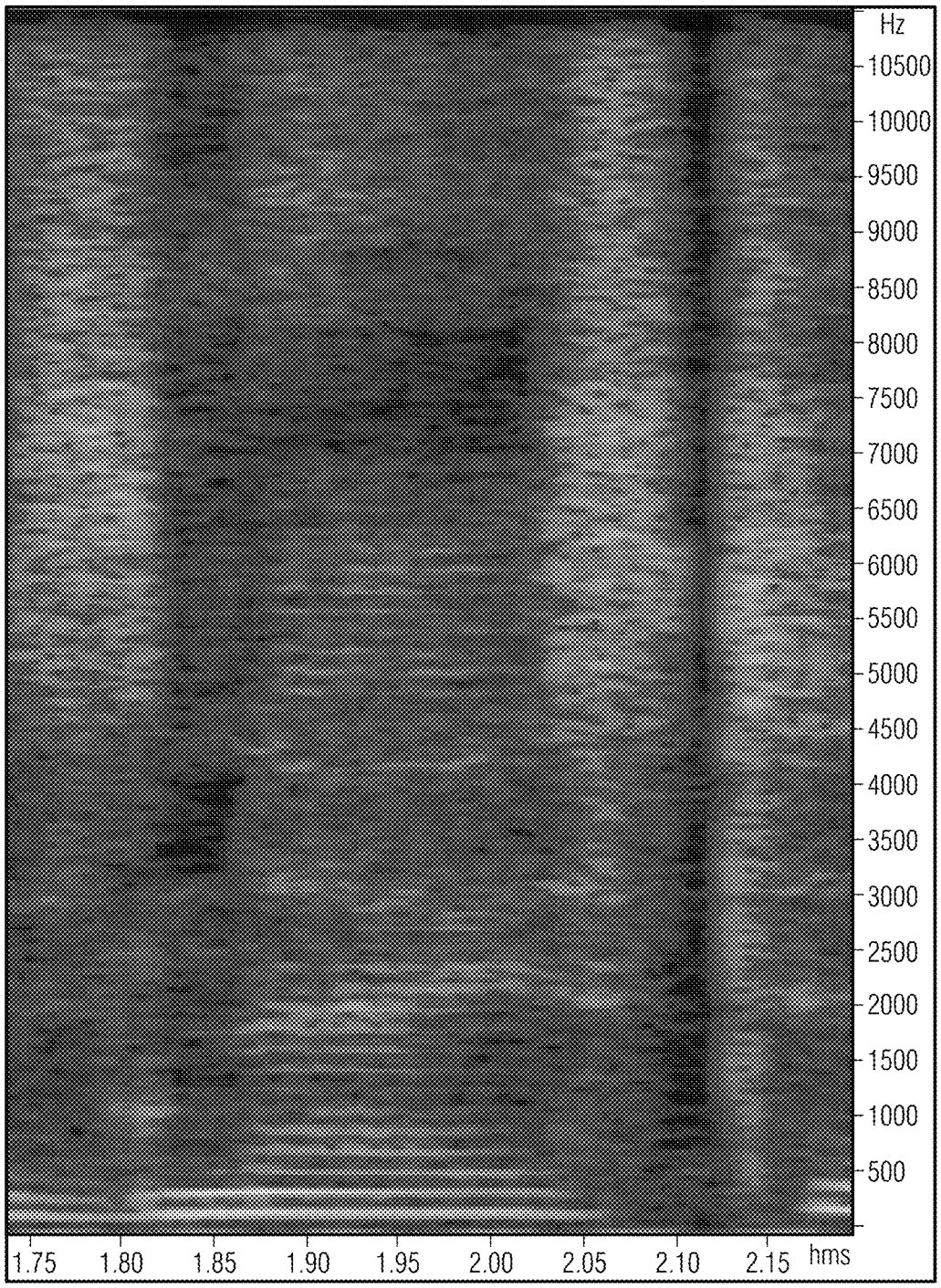

FIG. 12 shows a diagram 1200 with an error free signal, the abscissa indicating time and the ordinate indicating frequencies.

Figure 13:
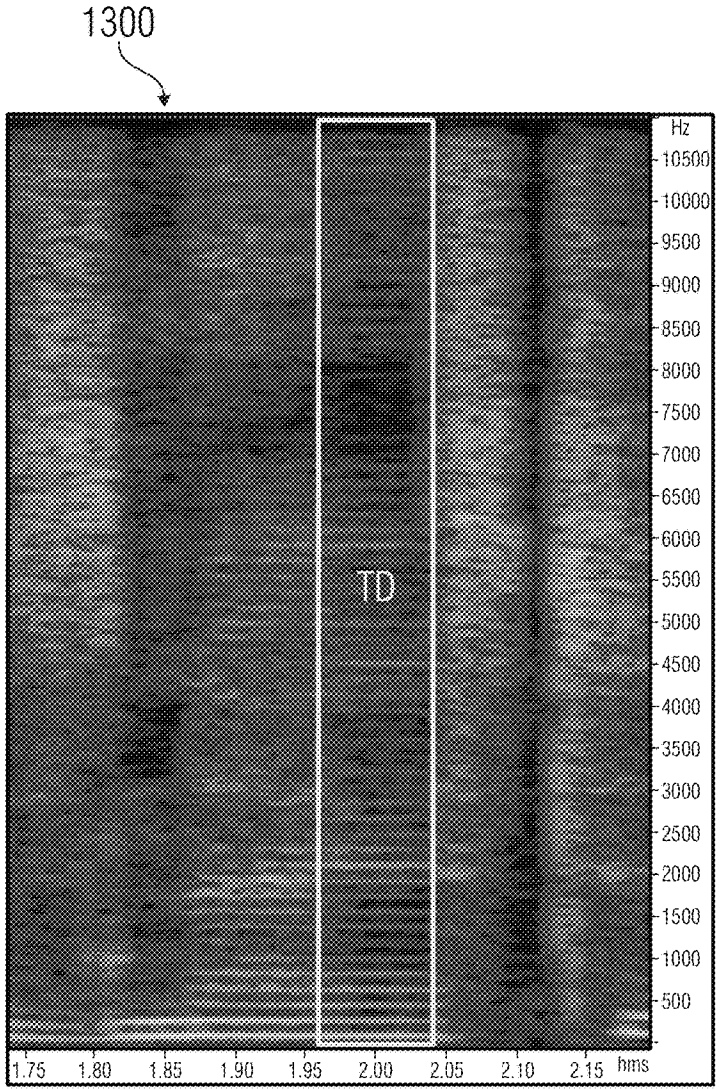

FIG. 13 shows a diagram 1300 in which a time domain concealment is applied to the whole frequency band of an error prone signal. The lines generated by the TD concealment show the artificially generated harmonicity on the full frequency range of an error prone signal.

FIG. 14 shows a diagram 1400 illustrating results of the present invention: noise (in the first frequency range 1401, here over 2.5 KHz) has been concealed with the frequency domain concealment (e.g., 105 or 805) and speech (in the second frequency range 1402, here below 2.5 KHz) has been concealed with the time domain concealment (e.g., 106, 500, 600, or 809). A comparison with FIG. 13 permits to understand that the artificially generated harmonicity on the noise frequency range has been avoided.

If the energy tilt of the harmonics is constant over the frequencies, it makes sense to do a full-frequency TD concealment and no FD concealment at all or the other way around if the signal contains no harmonicity.

Figure 16:
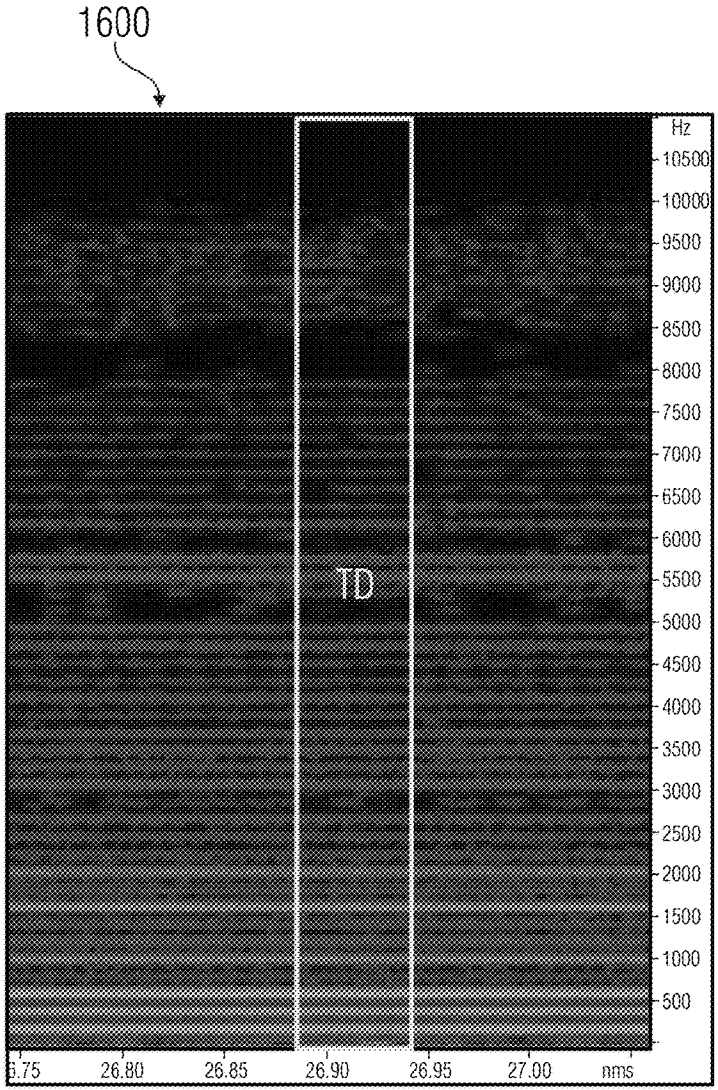
Figure 15:
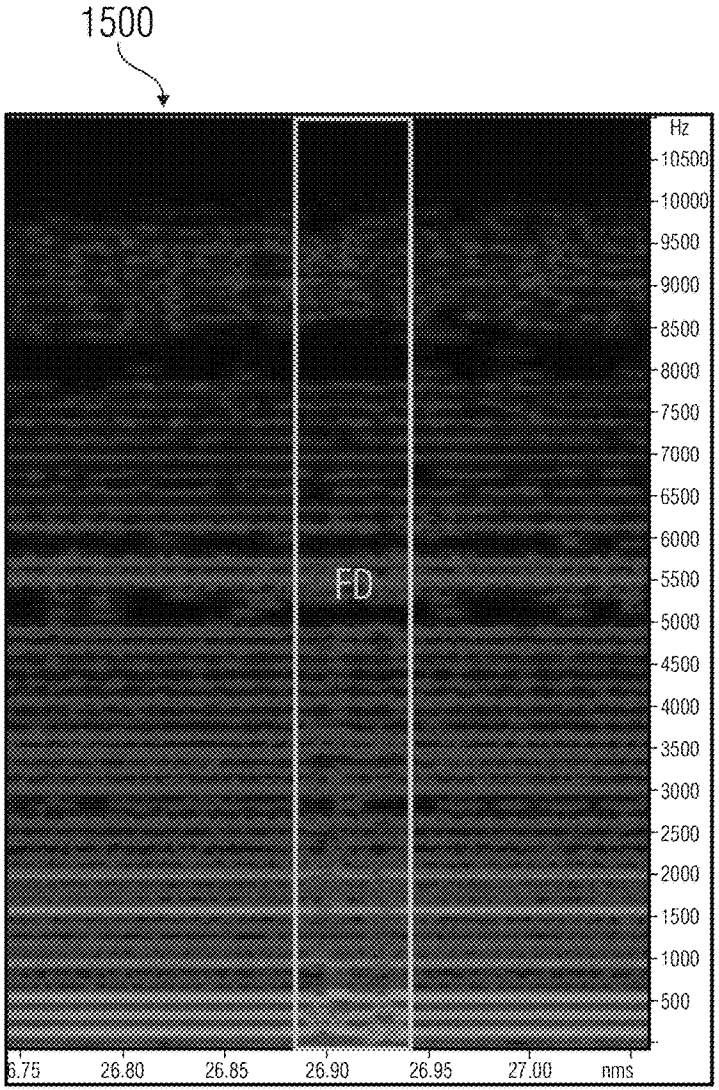

As can be seen from diagram 1500 of FIG. 15, frequency domain concealment tends to produce phase discontinuities, whereas, as can be seen from diagram 1600 of FIG. 16, time domain concealment applied to a full frequency range keeps the signal phase and produces perfect artifact free output.

Figure 18:
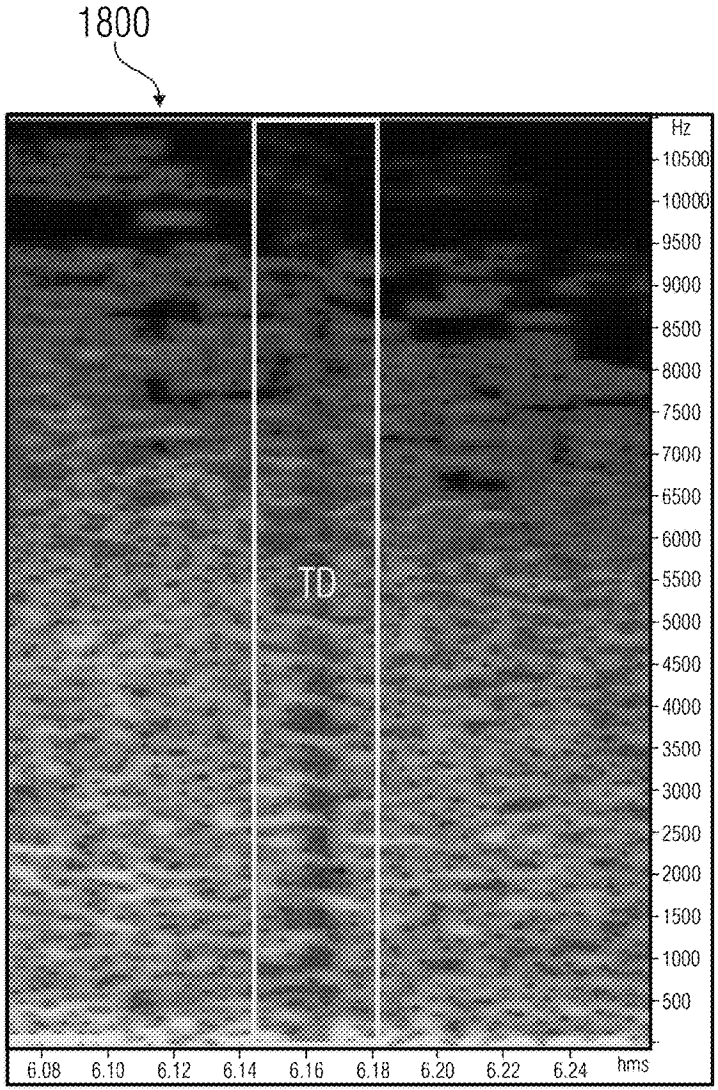
Figure 17:
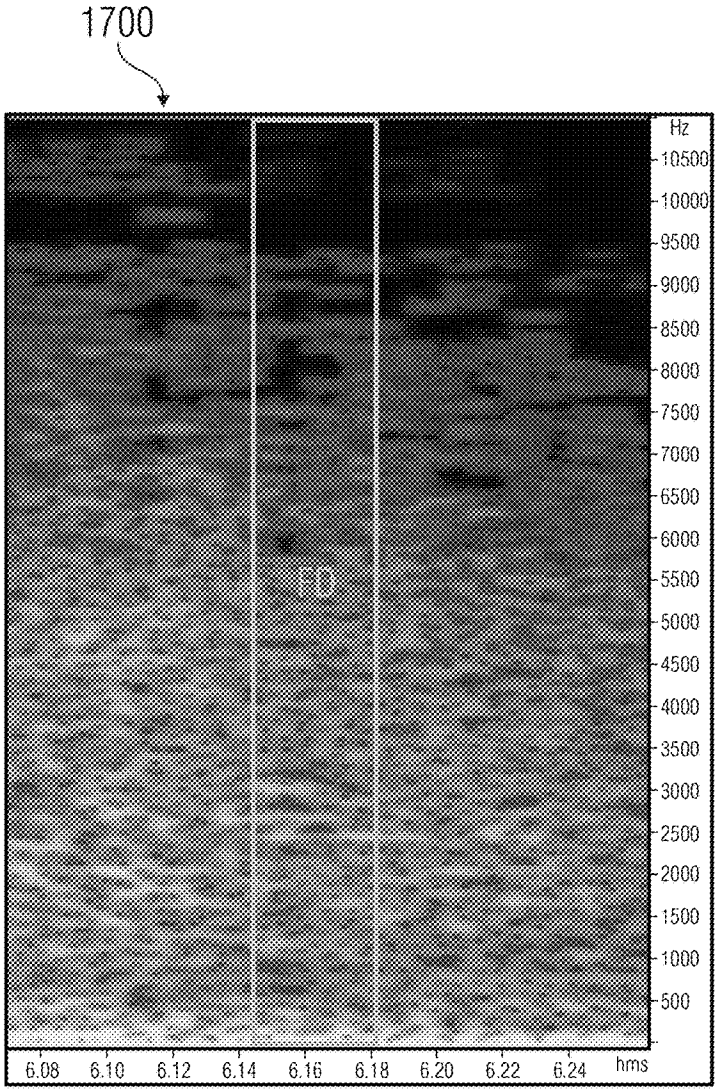

Diagram 1700 of FIG. 17 shows a FD concealment on the whole frequency band of an error prone signal. Diagram 1800 of FIG. 18 shows a TD concealment on the whole frequency band of an error prone signal. In this case, the FD concealment keeps signal characteristics, whereas the TD concealment on full frequency would create an annoying "beep" artifact, or create some big holes in the spectrum that are noticeable.

In particular, it is possible to shift between the operations shown in FIGS. 15-18 using the equipment shown in FIG. 8 or implementing the method of FIG. 10. A controller such as the controller 813 can operate a determination, e.g. by analysing the signal (energy, tilt, harmonicity, and so on), to arrive at the operation shown in FIG. 16 (only TD concealment) when the signal has strong harmonics. Analogously, the controller 813 can also operate a determination to arrive at the operation shown in FIG. 17 (only FD concealment) when noise is predominant.

6.1. Conclusions on the Basis of the Experimental Results

The conventional concealment technique in the AAC [1] audio codec is Noise Substitution. It is working in the frequency domain and it is well suited for noisy and music items. It has been recognized that for speech segments, Noise Substitution often produces phase discontinuities which end up in annoying click artefacts in the time domain. Therefore, an ACELP-like time domain approach can be used for speech segments (like TD-TCX PLC in [2][3]), determined by a classifier.

One problem with time domain concealment is the artificial generated harmonicity on the full frequency range. If the signal has only strong harmonics in lower frequencies, for speech items this is usually around 4 kHz, where by the higher frequencies consist of background noise, the generated harmonics up to Nyquist will produce annoying "beep"-artefacts. Another drawback of the time domain approach is the high computational complexity compared to error-free decoding or concealing with Noise Substitution.

To reduce the computational complexity, the claimed approach uses a combination of both methods:

- Time domain Concealment in the lower frequency part, where speech signals have their highest impact
- Frequency domain Concealment in the higher frequency part, where speech signals have noise characteristic.

6.1.1 Low Frequency Part (Core)

First the last pcm buffer is downsampled to the desired core sampling rate (here 16 kHz).

The Time domain concealment algorithm is performed to get one and a half synthesized frames. The additional half frame is later needed for the overlap-add (OLA) mechanism.

The synthesized signal is upsampled to the output sampling rate (FS_out) and filtered with a low pass filter with a cut-off frequency of FS_out/2.

6.1.2 High-Frequency Part

For the high frequency part, any frequency domain concealment can be applied. Here, Noise Substitution inside the AAC-ELD audio codec will be used. This mechanism uses a copied spectrum of the last good frame and adds noise before the IMDCT is applied to get back to time domain.

The concealed spectrum is transformed to time domain via IMDCT

In the end, the synthesized signal with the past pcm buffer is filtered with a high pass filter with a cut-off frequency of FS_out/2

6.1.2 Full Part

To combine the lower and high frequency part, the overlap and add mechanism is done in the time domain. For AAC like codec, this means that more than one frame (typically one and a half frames) have to be updated for one concealed frame. That's because the analysis and synthesis method of the OLA has a half frame delay. The IMDCT produces only one frame, therefore an additional half frame is needed. Thus, the IMDCT is called twice to get two consecutive frames in the time domain.

The low frequency and high frequency part is summed up and the overlap add mechanism is applied.

6.1.3 Optional Extensions

It is possible to adapt dynamically the cross-over frequency between TD and FD concealment based on the harmonicity and tilt of the last good frame. For example in case of a female speech item with background noise, the signal can be down sampled to 5 kHz and the time domain concealment will do a good concealment for the most important part of the signal. The noisy part will then be synthesized with the frequency domain concealment method. This will reduce the complexity compared to a fixed cross over (or fix down sample factor) and remove the annoying "beep"-artefacts (see FIGS. 12-14).

6.1.4 Experimental Conclusions

FIG. 13 shows TD concealment on full frequency range; FIG. 14 shows hybrid concealment: 0 to 2.5 kHz (ref. 1402) with TD concealment and upper frequencies (ref. 1401) with FD concealment.

However, if the energy tilt of the harmonics is constant over the frequencies (and one clear pitch or harmonicity are detected), it makes sense to do a full frequency TD Concealment and no FD Concealment at all or the other way around if the signal contains no harmonicity.

FD concealment (FIG. 15) produces phase discontinuities, whereas TD concealment (FIG. 16) applied on full frequency range keeps the signals phase and produce approximately (in some cases even perfect) artifact free output (perfect artifact free output can be achieved with really tonal signals). FD concealment (FIG. 17) keeps signal characteristic, where by TD concealment (FIG. 18) on full frequency range creates annoying "beep"-artefact If the pitch is known for every frame, it is possible to make use of one key advantage of time domain concealment compared to any frequency domain tonal concealment, that we can vary the pitch inside the concealed frame, based on the past pitch value (if delay requirements permit we can also use future frame for interpolation).

7. ADDITIONAL REMARKS

Embodiments relate to a hybrid concealment method, which comprises a combination of frequency and time domain concealment for audio codecs. In other words, embodiments relate to a hybrid concealment method in frequency and time domain for audio codecs.

A conventional packet loss concealment technique in the AAC family audio codec is Noise Substitution. It is working in the frequency domain (FDPLC—frequency domain packet loss concealment) and is well-suited for noisy and music items. It has been found that for speech segments, it often produces phase discontinuities which end up in annoying click artifacts. To overcome that problem an ACELP-like time domain approach TDPLC (time domain packet loss concealment) is used for speech like segments. To avoid the computational complexity and high frequency artifacts of the TDPLC, the described approach uses adaptive combination of both concealment methods: TDPLC for lower frequencies, FDPLC for higher frequencies.

Embodiments according to the invention can be used in combination with any of the following concepts: ELD, XLD, DRM, MPEG-H.

8. IMPLEMENTATION ALTERNATIVES

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

The apparatus described herein may be implemented using a hardware apparatus, or using a computer, or using a combination of a hardware apparatus and a computer.

The methods described herein may be performed using a hardware apparatus, or using a computer, or using a combination of a hardware apparatus and a computer.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

9. BIBLIOGRAPHY

[1] 3GPP TS 26.402 "Enhanced aacPlus general audio codec; Additional decoder tools (Release 11)",

[2] J. Lecomte, et al, "Enhanced time domain packet loss concealment in switched speech/audio codec", submitted to IEEE ICASSP, Brisbane, Australia, April 2015.

[3] WO 2015063045 A1

[4] "Apparatus and method for improved concealment of the adaptive codebook in ACELP-like concealment employing improved pitch lag estimation", 2014, PCT/EP2014/062589

[5] "Apparatus and method for improved concealment of the adaptive codebook in ACELP-like concealment employing improved pulse "synchronization", 2014, PCT/EP2014/062578

The invention claimed is:

1. An error concealment unit for providing an error concealment audio information for concealing a loss of an audio frame in an encoded audio information, wherein the error concealment unit is configured to provide a first error concealment audio information component for a first frequency range using a frequency domain concealment, wherein the error concealment unit is further configured to provide a second error concealment audio information component for a second frequency range, which comprises lower frequencies than the first frequency range, using a time domain concealment, and wherein the error concealment unit is further configured to combine the first error concealment audio information component and the second error concealment audio information component, to acquire the error concealment audio information, wherein the error concealment unit is configured to perform a control so as to adapt a lower frequency end of the first frequency range and/or a higher frequency end of the second frequency range in dependence on an energy relationship between harmonics and noise.

2. The error concealment unit according to claim 1, wherein the error concealment unit is configured such that the first error concealment audio information component represents a high frequency portion of a given lost audio frame, and such that the second error concealment audio information component represents a low frequency portion of the given lost audio frame, such that error concealment audio information associated with the given lost audio frame is acquired using both the frequency domain concealment and the time domain concealment.

3. The error concealment unit according to claim 1, wherein the error concealment unit is configured to derive the first error concealment audio information component using a transform domain representation of a high frequency portion of a properly decoded audio frame preceding a lost audio frame, and/or wherein the error concealment unit is configured to derive the second error concealment audio information component using a time domain signal synthesis on the basis of a low frequency portion of the properly decoded audio frame preceding the lost audio frame.

4. The error concealment unit according to claim 3, wherein the error concealment unit is configured to acquire one or more synthesis stimulus parameters and one or more synthesis filter parameters on the basis of the low frequency portion of the properly decoded audio frame preceding the lost audio frame, and to acquire the second error concealment audio information component using a signal synthesis, stimulus parameters and filter parameters of which signal synthesis are derived on the basis of the acquired synthesis stimulus parameters and the acquired synthesis filter parameters or equal to the acquired synthesis stimulus parameters and the acquired synthesis filter parameters.

5. The error concealment unit according to claim 1, wherein the error concealment unit is configured to use a scaled or unscaled copy of the transform domain representation of the high frequency portion of the properly decoded audio frame preceding the lost audio frame, to acquire a transform domain representation of the high frequency portion of the lost audio frame, and to convert the transform domain representation of the high frequency portion of the lost audio frame into the time domain, to acquire a time domain signal component which is the first error concealment audio information component.

6. The error concealment unit according to claim 1, wherein the error concealment unit is configured to perform the control to determine and/or signal-adaptively vary the first and/or second frequency ranges.

7. The error concealment unit according to claim 6, wherein the error concealment unit is configured to perform the control on the basis of characteristics chosen between characteristics of one or more encoded audio frames and characteristics of one or more properly decoded audio frames.

8. The error concealment unit according to claim 6, wherein the error concealment unit is configured to acquire an information about a harmonicity of one or more properly decoded audio frames and to perform the control on the basis of the information on the harmonicity; and/or wherein the error concealment unit is configured to acquire an information about a spectral tilt of one or more properly decoded audio frames and to perform the control on the basis of the information about the spectral tilt.

9. The error concealment unit according to claim 8, wherein the error concealment unit is configured to determine or estimate a frequency border at which a spectral tilt of the properly decoded audio frame preceding a lost audio frame changes from a smaller spectral tilt to a larger spectral tilt, and to choose the first frequency range and the second frequency range in dependence thereon.

10. The error concealment unit according to claim 6, wherein the error concealment unit is configured to perform the control on the basis of information transmitted by an encoder.

11. The error concealment unit according to claim 1, wherein the error concealment unit is configured to perform the control so as to selectively inhibit at least one of the time domain concealment and frequency domain concealment and/or to perform time domain concealment only or the frequency domain concealment only to acquire the error concealment audio information.

12. The error concealment unit according to claim 11, wherein the error concealment unit is configured to determine or estimate whether a variation of a spectral tilt of the properly decoded audio frame preceding the lost audio frame is smaller than a predetermined spectral tilt threshold over a given frequency range, and to acquire the error concealment audio information using the time-domain concealment only if it is found that the variation of a spectral tilt of the properly decoded audio frame preceding the lost audio frame is smaller than the predetermined spectral tilt threshold.

13. The error concealment unit according to claim 11, wherein the error concealment unit is configured to determine or estimate whether a harmonicity of the properly decoded audio frame preceding the lost audio frame is smaller than a predetermined harmonicity threshold, and to acquire the error concealment audio information using the frequency-domain concealment only if it is found that the harmonicity of the properly decoded audio frame preceding the lost audio frame is smaller than the predetermined harmonicity threshold.

14. The error concealment unit according to claim 1, wherein the error concealment unit is configured to adapt a pitch of a concealed frame based on a pitch of a properly decoded audio frame preceding a lost audio frame and/or in dependence of a temporal evolution of the pitch in the properly decoded audio frame preceding the lost audio frame, and/or in dependence on an interpolation of the pitch between the properly decoded audio frame preceding the lost audio frame and a properly decoded audio frame following the lost audio frame.

15. The error concealment unit according to claim 1, wherein the error concealment unit is further configured to combine the first error concealment audio information component and the second error concealment audio information component using an overlap-and-add, OLA, mechanism.

16. The error concealment unit according to claim 1, wherein the error concealment unit is configured to provide the second error concealment audio information component such that the second error concealment audio information component comprises a temporal duration which is at least 25 percent longer than the lost audio frame, to allow for an overlap-and-add.

17. The error concealment unit according to claim 1, wherein the error concealment unit is configured to perform an inverse modified discrete cosine transform, IMDCT, on the basis of a spectral domain representation acquired by the frequency domain error concealment, in order to acquire a time domain representation of the first error concealment audio information component.

18. The error concealment unit according to claim 17, wherein the error concealment unit is configured to perform an IMDCT twice to get two consecutive frames in the time domain.

19. The error concealment unit according to claim 1, wherein the error concealment unit is configured to perform a high pass filtering of the first error concealment audio information component, downstream of the frequency domain concealment.

20. The error concealment unit according to claim 19, wherein the error concealment unit is configured to perform a high pass filtering with a cutoff frequency between 6 KHz and 10 KHz, advantageously 7 KHz and 9 KHz, more advantageously between 7.5 KHz and 8.5 KHz, even more advantageously between 7.9 KHz and 8.1 KHz, and even more advantageously 8 KHz.

21. The error concealment unit according to claim 19, wherein the error concealment unit is configured to signal-adaptively adjust a lower frequency boundary of the high-pass filtering, to thereby vary a bandwidth of the first frequency range.

22. The error concealment unit according to claim 1, wherein the error concealment unit is configured to down-sample a time-domain representation of an audio frame preceding the lost audio frame, in order to acquire a down-sampled time-domain representation of the audio frame preceding the lost audio frame which down-sampled time-domain representation only represents a low frequency portion of the audio frame preceding the lost audio frame, and to perform the time domain concealment using the down-sampled time-domain representation of the audio frame preceding the lost audio frame, and to up-sample a concealed audio information provided by the time domain concealment, or a post-processed version thereof, in order to acquire the second error concealment audio information component, such that the time domain concealment is performed using a sampling frequency which is smaller than a sampling frequency involved to fully represent the audio frame preceding the lost audio frame.

23. The error concealment unit according to claim 22, wherein the error concealment unit is configured to signal-adaptively adjust a sampling rate of the down-sampled time-domain representation, to thereby vary a bandwidth of the second frequency range.

24. The error concealment unit according to claim 1, wherein the error concealment unit is configured to perform a fade out using a damping factor.

25. The error concealment unit according to claim 1, wherein the error concealment unit is configured to scale a spectral representation of the audio frame preceding the lost audio frame using the damping factor, in order to derive the first error concealment audio information component.

26. The error concealment unit according to claim 1, wherein the error concealment is configured to low-pass filter an output signal of the time domain concealment, or an up-sampled version thereof, in order to acquire the second error concealment audio information component.

27. An audio decoder for providing a decoded audio information on the basis of encoded audio information, the audio decoder comprising an error concealment unit according to claim 1.

28. The audio decoder according to claim 27, wherein the audio decoder is configured to acquire a spectral domain representation of an audio frame on the basis of an encoded representation of the spectral domain representation of the audio frame, and wherein the audio decoder is configured to perform a spectral-domain-to-time-domain conversion, in order to acquire a decoded time representation of the audio frame, wherein the error concealment is configured to perform the frequency domain concealment using of a spectral domain representation of a properly decoded audio frame preceding a lost audio frame, or a portion thereof, and wherein the error concealment is configured to perform the time domain concealment using a decoded time domain representation of a properly decoded audio frame preceding the lost audio frame.

29. An error concealment unit for providing an error concealment audio information for concealing a loss of an audio frame in an encoded audio information, wherein the error concealment unit is configured to provide a first error concealment audio information component for a first frequency range using a frequency domain concealment, wherein the error concealment unit is further configured to provide a second error concealment audio information component for a second frequency range, which comprises lower frequencies than the first frequency range, using a time domain concealment, and wherein the error concealment unit is further configured to combine the first error concealment audio information component and the second error concealment audio information component, to acquire the error concealment audio information, wherein the error concealment unit is configured to perform the control to determine and/or signal-adaptively vary the first and/or second frequency ranges, wherein the error concealment unit is configured to acquire an information about one or more properly decoded audio frames and to perform the control on the basis of the information on the harmonicity; and/or wherein the error concealment unit is configured to acquire an information about a spectral tilt of one or more properly decoded audio frames and to perform the control on the basis of the information about the spectral tilt, wherein the error concealment unit is configured to choose the first frequency range and the second frequency range such that the harmonicity is comparatively smaller in the first frequency range when compared to the harmonicity in the second frequency range.

30. An error concealment unit for providing an error concealment audio information for concealing a loss of an audio frame in an encoded audio information, wherein the error concealment unit is configured to provide a first error concealment audio information component for a first frequency range using a frequency domain concealment, wherein the error concealment unit is further configured to provide a second error concealment audio information component for a second frequency range, which comprises lower frequencies than the first frequency range, using a time domain concealment, and wherein the error concealment unit is further configured to combine the first error concealment audio information component and the second error concealment audio information component, to acquire the error concealment audio information, wherein the error concealment unit is configured to perform the control to determine and/or signal-adaptively vary the first and/or second frequency ranges, wherein the error concealment unit is configured to acquire an information about one or more properly decoded audio frames and to perform the control on the basis of the information on the harmonicity; and/or wherein the error concealment unit is configured to acquire an information about a spectral tilt of one or more properly decoded audio frames and to perform the control on the basis of the information about the spectral tilt, wherein the error concealment unit is configured to determine up to which frequency the properly decoded audio frame preceding the lost audio frame comprises a harmonicity which is stronger than a harmonicity threshold, and to choose the first frequency range and the second frequency range in dependence thereon.

31. An error concealment unit for providing an error concealment audio information for concealing a loss of an audio frame in an encoded audio information, wherein the error concealment unit is configured to provide a first error concealment audio information component for a first frequency range using a frequency domain concealment, wherein the error concealment unit is further configured to provide a second error concealment audio information component for a second frequency range, which comprises lower frequencies than the first frequency range, using a time domain concealment, and wherein the error concealment unit is further configured to combine the first error concealment audio information component and the second error concealment audio information component, to acquire the error concealment audio information, wherein the error concealment unit is configured to adjust the first frequency range and the second frequency range, such that the first frequency range covers a spectral region which comprises a noise-like spectral structure, and such that the second frequency range covers a spectral region which comprises a harmonic spectral structure.

32. An error concealment method for providing an error concealment audio information for concealing a loss of an audio frame in an encoded audio information, the method comprising:

providing a first error concealment audio information component for a first frequency range using a frequency domain concealment, providing a second error concealment audio information component for a second frequency range, which comprises lower frequencies than the first frequency range, using a time domain concealment, and combining the first error concealment audio information component and the second error concealment audio information component, to acquire the error concealment audio information, wherein the method comprises signal-adaptively controlling the first and second frequency ranges by adapting a lower frequency end of the first frequency range and/or a higher frequency end of the second frequency range in dependence on an energy relationship between harmonics and noise.

33. The error concealment method according to claim 32, wherein the method comprises signal-adaptively switching to a mode in which only a time domain concealment or only a frequency domain concealment is used to acquire an error concealment audio information for at least one lost audio frame.

34. An error concealment unit for providing an error concealment audio information for concealing a loss of an audio frame in an encoded audio information, wherein the error concealment unit is configured to provide a first error concealment audio information component for a first frequency range using a frequency domain concealment, wherein the error concealment unit is further configured to provide a second error concealment audio information component for a second frequency range, which comprises lower frequencies than the first frequency range, using a time domain concealment, and wherein the error concealment unit is further configured to combine the first error concealment audio information component and the second error concealment audio information component, to acquire the error concealment audio information, wherein the error concealment unit is configured to perform a control to determine and/or signal-adaptively vary the first and/or second frequency ranges, by adapting a lower frequency end of the first frequency range and/or a higher frequency end of the second frequency range in dependence on an energy relationship between harmonics and noise.

35. An error concealment method for providing an error concealment audio information for concealing a loss of an audio frame in an encoded audio information, the method comprising:

providing a first error concealment audio information component for a first frequency range using a frequency domain concealment, providing a second error concealment audio information component for a second frequency range, which comprises lower frequencies than the first frequency range, using a time domain concealment, and combining the first error concealment audio information component and the second error concealment audio information component, to acquire the error concealment audio information, wherein the method comprises signal-adaptively controlling the first and second frequency ranges, to adapt a lower frequency end of the first frequency range and/or a higher frequency end of the second frequency range in dependence on an energy relationship between harmonics and noise.

36. An error concealment method for providing an error concealment audio information for concealing a loss of an audio frame in an encoded audio information, the method comprising:

providing a first error concealment audio information component for a first frequency range using a frequency domain concealment, providing a second error concealment audio information component for a second frequency range, which comprises lower frequencies than the first frequency range, using a time domain concealment, combining the first error concealment audio information component and the second error concealment audio information component, to acquire the error concealment audio information, wherein the method includes adjusting the first frequency range and the second frequency range, such that the first frequency range covers a spectral region which comprises a noise-like spectral structure, and such that the second frequency range covers a spectral region which comprises a harmonic spectral structure.

* * * * *